US011470438B2

(12) United States Patent
Uhle et al.

(10) Patent No.: US 11,470,438 B2
(45) Date of Patent: Oct. 11, 2022

(54) AUDIO SIGNAL PROCESSOR, SYSTEM AND METHODS DISTRIBUTING AN AMBIENT SIGNAL TO A PLURALITY OF AMBIENT SIGNAL CHANNELS

(71) Applicant: Fraunhofer-Gesellschaft zur Foerderung der angewandten Forschung e.V., Munich (DE)

(72) Inventors: Christian Uhle, Ursensollen (DE); Oliver Hellmuth, Buckenhof (DE); Julia Havenstein, Nuremberg (DE); Timothy Leonard, Nuremberg (DE); Matthias Lang, Freystadt (DE); Marc Hoepfel, Nuremberg (DE); Peter Prokein, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 247 days.

(21) Appl. No.: 16/942,437

(22) Filed: Jul. 29, 2020

(65) Prior Publication Data

US 2020/0359155 A1 Nov. 12, 2020

Related U.S. Application Data

(63) Continuation of application No. PCT/EP2019/052018, filed on Jan. 28, 2019.

(30) Foreign Application Priority Data

Jan. 29, 2018 (EP) ..... 18153968

(51) Int. Cl.
*H04S 7/00* (2006.01)
*G10L 19/008* (2013.01)
(Continued)

(52) U.S. Cl.
CPC ..... *H04S 7/302* (2013.01); *G10L 19/008* (2013.01); *H04R 5/04* (2013.01); *H04S 3/008* (2013.01); *H04S 5/005* (2013.01); *H04S 2400/11* (2013.01)

(58) Field of Classification Search
None
See application file for complete search history.

(56) References Cited

U.S. PATENT DOCUMENTS 6,658,117 B2 12/2003 Hasebe
8,036,767 B2 10/2011 Soulodre
(Continued)

FOREIGN PATENT DOCUMENTS

CN 103621110 A 3/2014
CN 105960675 A 9/2016
(Continued)

OTHER PUBLICATIONS

Allen, J. B., et al., "Multimicrophone signal-processing technique to remove room reverberation from speech signals", J. Acoust. Soc. Am., vol. 62, 1977, Mar. 17, 1977.
(Continued)

*Primary Examiner* — Paul W Huber
(74) *Attorney, Agent, or Firm* — Perkins Coie LLP; Michael A. Glenn

(57) ABSTRACT

An audio signal processor for providing ambient signal channels on the basis of an input audio signal, is configured to extract an ambient signal on the basis of the input audio signal. The signal processor is configured to distribute the ambient signal to a plurality of ambient signal channels in dependence on positions or directions of sound sources within the input audio signal, wherein a number of ambient signal channels is larger than a number of channels of the input audio signal.

39 Claims, 7 Drawing Sheets

(51) Int. Cl.

| | |
|---|---|
| ***H04R 5/04*** | (2006.01) |
| ***H04S 3/00*** | (2006.01) |
| ***H04S 5/00*** | (2006.01) |

(56) References Cited

U.S. PATENT DOCUMENTS

| | | | | |
|---|---|---|---|---|
| 8,379,868 | B2 * | 2/2013 | Goodwin | G10L 19/008 381/23 |
| 8,932,134 | B2 | 1/2015 | Andall | |
| 9,805,726 | B2 * | 10/2017 | Adami | H04S 5/00 |
| 2002/0057806 | A1 | 5/2002 | Hasebe | |
| 2014/0064527 | A1 | 3/2014 | Walther et al. | |
| 2015/0230041 | A1 | 8/2015 | Fejzo et al. | |
| 2016/0212563 | A1 | 7/2016 | Yuyama et al. | |
| 2020/0353765 | A1 | 11/2020 | Kaniewska et al. | |

FOREIGN PATENT DOCUMENTS

| | | | |
|---|---|---|---|
| DE | 102015205042 | A1 | 9/2016 |
| EP | 2733964 | A1 | 5/2014 |
| EP | 3048818 | A1 | 7/2016 |
| JP | 2000152399 | A | 5/2000 |
| JP | 2014513502 | A | 5/2014 |
| JP | 2014523174 | A | 9/2014 |
| RU | 2437247 | C1 | 12/2011 |
| WO | 2012032178 | A1 | 3/2012 |
| WO | 2013004698 | A1 | 1/2013 |
| WO | 2014135235 | A1 | 9/2014 |

OTHER PUBLICATIONS

Avendano, Carlos, et al., "A frequency-domain approach to multichannel upmix", J. Audio Eng. Soc., vol. 52, 2004.

Barry, Dan, et al., "Sound source separation: Azimuth discrimination and resynthesis", in Proc. Int. Conf Digital Audio Effects ( DAFx).

Faller, Christof, "Multiple-loudspeaker playback of stereo signals", J. Audio Eng. Soc., vol. 54.

He, Jianjun, et al., "Linear estimation based primary-ambient extraction for stereo audio signals", EEE/ACM Trans. Audio, Speech, and Language Process., vol. 22, No. 2.

Merimaa, Juha, et al., "Correlationbased ambience extraction from stereo recordings,", in Proc. Audio Eng. Soc. /23rd Conv.

Uhle, Christian, "Center signal scaling using signal-to-downmix ratios", in Proc. Int. Conf. Digital Audio Effects, DAFx.

Uhle, Christian, et al., "Direct-ambient decomposition using parametric Wiener filtering with spatial cue control", in Proc.Int. Conf on Acoust., Speech and Sig. Process., ICASSP.

Uhle, Christian, et al., "Subband center signal scaling using power ratios", in Proc. AES 53rd Conf Semantic Audio.

Usher, John, et al., "Enhancement of spatial sound quality: A new reverberationextraction audio upmixer", IEEE Trans. Audio, Speech, and Language Process., vol. 15, pp. 2141-2150.

Walther, Andreas, et al., "Direct-ambient decomposition and upmix of surround sound signals", in Proc.IEEE WASPAA.

* cited by examiner

AUDIO SIGNAL PROCESSOR, SYSTEM AND METHODS DISTRIBUTING AN AMBIENT SIGNAL TO A PLURALITY OF AMBIENT SIGNAL CHANNELS

CROSS-REFERENCES TO RELATED APPLICATIONS

This application is a continuation of copending International Application No. PCT/EP2019/052018, filed Jan. 28, 2019, which is incorporated herein by reference in its entirety, and additionally claims priority from European Application No. EP 18 153 968.5, filed Jan. 29, 2018, which is incorporated herein by reference in its entirety.

Embodiments according to the present invention are related to an audio signal processor for providing ambient signal channels on the basis of an input audio signal.

Embodiments according to the invention are related to a system for rendering an audio content represented by a multi-channel input audio signal.

Embodiments according to the invention are related to a method for providing ambient signal channels on the basis of an input audio signal.

Embodiments according to the invention are related to a method for rendering an audio content represented by a multi-channel input audio signal.

Embodiments according to the invention are related to a computer program.

Embodiments according to the invention are generally related to an ambient signal extraction with multiple output channels.

BACKGROUND OF THE INVENTION

A processing and rendering of audio signals is an emerging technical field. In particular, proper rendering of multi-channel signals comprising both direct sounds and ambient sounds provides a challenge.

Audio signals can be mixtures of multiple direct sounds and ambient (or diffuse) sounds. The direct sound signals are emitted by sound sources, e.g. musical instruments, and arrive at the listener's ear on the direct (shortest) path between the source and the listener. The listener can localize their position in the spatial sound image and point to the direction at which the sound source is located. The relevant auditory cues for the localization are interaural level difference, interaural time difference and interaural coherence. Direct sound waves evoking identical interaural level difference and interaural time difference are perceived as coming from the same direction. In the absence of diffuse sound, the signals reaching the left and the right ear or any other multitude of sensors are coherent [1].

Ambient sounds, in contrast, are perceived as being diffuse, not locatable, and evoke an impression of envelopment (of being "immersed in sound") by the listener. When capturing an ambient sound field using a multitude of spaced sensors, the recorded signals are at least partially incoherent. Ambient sounds are composed of many spaced sounds sources. An example is applause, i.e. the superimposition of many hands clapping at multiple positions. Another example is reverberation, i.e. the superimposition of sounds reflected on boundaries or walls. When a soundwave reaches a wall in a room, a portion of it is reflected, and the superposition of all reflections in a room, the reverberation, is the most prominent ambient sound. All reflected sounds originate from an excitation signal generated by a direct sound source, e.g. the reverberant speech is produced by a speaker in a room at a locatable position.

Various applications of sound post-production and reproduction apply a decomposition of audio signals into direct signal components and ambient signal components, i.e. direct-ambient decomposition (DAD), or an extraction of an ambient (diffuse) signal, i.e. ambient signal extraction (ASE). The aim of ambient signal extraction is to compute an ambient signal where all direct signal components are attenuated and only the diffuse signal components are audible.

Until now, the extraction of the ambient signal has been restricted to output signals having the same number of channels as the input signal (confer, for example, references [2], [3], [4], [5], [6], [7], [8]), or even less. When processing a two-channel stereo signal, an ambient signal having one or two channels is produced.

A method for ambient signal extraction from surround sound signals has been proposed in [9] that processes input signals with N channels, where N>2. The method computes spectral weights that are applied to each input channel from a downmix of the multi-channel input signal and thereby produces an output signal with N signals.

Furthermore, various methods have been proposed for separating the aural signal components or the direct signal components only according to their location in the stereo image, for example, [2], [10], [11], [12].

In view of the conventional solutions, there is a desire to create a concept to obtain ambient signals which allows to obtain an improved hearing impression.

SUMMARY

An embodiment may have an audio signal processor for providing ambient signal channels on the basis of an input audio signal, wherein the audio signal processor is configured to obtain the ambient signal channels, wherein a number of obtained ambient signal channels including different audio content is larger than a number of channels of the input audio signal; wherein the audio signal processor is configured to obtain the ambient signal channels such that ambient signal components are distributed among the ambient signal channels in dependence on positions or directions of sound sources within the input audio signal; wherein the audio signal processor is configured to extract an ambient signal on the basis of the input audio signal; wherein the audio signal processor is configured to distribute ambient signal components among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels.

Another embodiment may have an audio signal processor for providing ambient signal channels on the basis of an input audio signal, wherein the audio signal processor is configured to obtain the ambient signal channels, wherein a number of obtained ambient signal channels including different audio content is larger than a number of channels of the input audio signal; wherein the audio signal processor is configured to obtain the ambient signal channels such that ambient signal components are distributed among the ambient signal channels in dependence on positions or directions of sound sources within the input audio signal; wherein the audio signal processor is configured to obtain a direct signal, which includes direct sound components, on the basis of the input audio signal; wherein the audio signal processor is configured to extract an ambient signal on the basis of the input audio signal; and wherein the signal processor is configured to distribute the ambient signal to a plurality of ambient signal channels in dependence on positions or directions of sound sources within the input audio signal, wherein a number of ambient signal channels is larger than a number of channels of the input audio signal; wherein the ambient signal channels are associated with different directions; wherein direct signal channels are associated with different directions, wherein the ambient signal channels and the direct signal channels are associated with the same set of directions, or wherein the ambient signal channels are associated with a subset of the set of directions associated with the direct signal channels; and wherein the audio signal processor is configured to distribute direct signal components among direct signal channels according to positions or directions of respective direct sound components, and wherein the audio signal processor is configured to distribute the ambient signal components among the ambient signal channels according to positions or directions of direct sound sources exciting the respective ambient signal components using the same panning coefficients or spectral weights using which the direct signal components are distributed.

Another embodiment may have an audio signal processor for providing ambient signal channels on the basis of an input audio signal, wherein the audio signal processor is configured to obtain the ambient signal channels, wherein a number of obtained ambient signal channels including different audio content is larger than a number of channels of the input audio signal; wherein the audio signal processor is configured to obtain the ambient signal channels such that ambient signal components are distributed among the ambient signal channels in dependence on positions or directions of sound sources within the input audio signal; wherein the audio signal processor is configured to obtain a direct signal, which includes direct sound components, on the basis of the input audio signal; wherein the audio signal processor is configured to extract an ambient signal on the basis of the input audio signal; and wherein the signal processor is configured to distribute the ambient signal to a plurality of ambient signal channels in dependence on positions or directions of sound sources within the input audio signal, wherein a number of ambient signal channels is larger than a number of channels of the input audio signal; wherein the audio signal processor is configured to obtain a direct signal on the basis of the input audio signal; wherein the audio signal processor is configured to apply spectral weights, in order to distribute the ambient signal the ambient signal channels; wherein the audio signal processor is configured to apply a same set of spectral weights for distributing direct signal components to direct signal channels and for distributing ambient signal components of the ambient signal to ambient signal channels.

Another embodiment may have an audio signal processor for providing ambient signal channels on the basis of an inventive input audio signal, wherein the audio signal processor is configured to extract an ambient signal on the basis of the input audio signal; and wherein the signal processor is configured to distribute the ambient signal to a plurality of ambient signal channels in dependence on positions or directions of sound sources within the input audio signal, wherein a number of ambient signal channels is larger than a number of channels of the input audio signal.

Another embodiment may have a system for rendering an audio content represented by a multi-channel input audio signal, including: an inventive audio signal processor as mentioned above, wherein the audio signal processor is configured to provide more than 2 direct signal channels and more than 2 ambient signal channels; and a speaker arrangement including a set of direct signal speakers and a set of ambient signal speakers, wherein each of the direct signal channels is associated to at least one of the direct signal speakers, and wherein each of the ambient signal channels is associated with at least one of the ambient signal speakers.

Another embodiment may have a method for providing ambient signal channels on the basis of an input audio signal, wherein the method includes obtaining the ambient signal channels such that ambient signal components are distributed among the ambient signal channels in dependence on positions or directions of sound sources within the input audio signal, wherein a number of obtained ambient signal channels including different audio content is larger than a number of channels of the input audio signal; wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels.

Another embodiment may have a method for providing ambient signal channels on the basis of an input audio signal, wherein the method includes obtaining the ambient signal channels such that ambient signal components are distributed among the ambient signal channels in dependence on positions or directions of sound sources within the input audio signal, wherein a number of obtained ambient signal channels including different audio content is larger than a number of channels of the input audio signal; wherein the method includes obtaining a direct signal, which includes direct sound components, on the basis of the input audio signal; wherein the method includes extracting an ambient signal on the basis of the input audio signal; and wherein the method includes distributing the ambient signal to a plurality of ambient signal channels in dependence on positions or directions of sound sources within the input audio signal, wherein a number of ambient signal channels is larger than a number of channels of the input audio signal; wherein the ambient signal channels are associated with different directions; wherein direct signal channels are associated with different directions, wherein the ambient signal channels and the direct signal channels are associated with the same set of directions, or wherein the ambient signal channels are associated with a subset of the set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using the same panning coefficients or spectral weights using which the direct signal components are distributed.

Another embodiment may have a method for providing ambient signal channels on the basis of an input audio signal, wherein the method includes obtaining the ambient signal channels such that ambient signal components are distributed among the ambient signal channels in dependence on positions or directions of sound sources within the input audio signal, wherein a number of obtained ambient signal channels including different audio content is larger than a number of channels of the input audio signal; wherein the method includes obtaining a direct signal, which includes direct sound components, on the basis of the input audio signal; wherein the method includes extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal; wherein a direct signal is obtained on the basis of the input audio signal; wherein spectral weights are applied, in order to distribute the ambient signal to the ambient signal channels; wherein a same set of spectral weights is applied for distributing direct signal components to direct signal channels and for distributing ambient signal components of the ambient signal to ambient signal channels.

Another embodiment may have a method for rendering an audio content represented by a multi-channel input audio signal, including: providing ambient signal channels on the basis of an input audio signal, wherein the method includes acquiring the ambient signal channels such that ambient signal components are distributed among the ambient signal channels in dependence on positions or directions of sound sources within the input audio signal, wherein a number of acquired ambient signal channels including different audio content is larger than a number of channels of the input audio signal; wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels, wherein more than 2 ambient signal channels are provided; providing more than 2 direct signal channels; feeding the ambient signal channels and the direct signal channels to a speaker arrangement including a set of direct signal speakers and a set of ambient signal speakers, wherein each of the direct signal channels is fed to at least one of the direct signal speakers, and wherein each of the ambient signal channels is fed with at least one of the ambient signal speakers.

Another embodiment may have a method for rendering an audio content represented by a multi-channel input audio signal, including: providing ambient signal channels on the basis of an input audio signal, wherein the method includes acquiring the ambient signal channels such that ambient signal components are distributed among the ambient signal channels in dependence on positions or directions of sound sources within the input audio signal, wherein a number of acquired ambient signal channels including different audio content is larger than a number of channels of the input audio signal; wherein the method includes acquiring a direct signal, which includes direct sound components, on the basis of the input audio signal; wherein the method includes extracting an ambient signal on the basis of the input audio signal; and wherein the method includes distributing the ambient signal to a plurality of ambient signal channels in dependence on positions or directions of sound sources within the input audio signal, wherein a number of ambient signal channels is larger than a number of channels of the input audio signal; wherein the ambient signal channels are associated with different directions; wherein direct signal channels are associated with different directions, wherein the ambient signal channels and the direct signal channels are associated with the same set of directions, or wherein the ambient signal channels are associated with a subset of the set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using the same panning coefficients or spectral weights using which the direct signal components are distributed, wherein more than 2 ambient signal channels are provided; providing more than 2 direct signal channels; feeding the ambient signal channels and the direct signal channels to a speaker arrangement including a set of direct signal speakers and a set of ambient signal speakers, wherein each of the direct signal channels is fed to at least one of the direct signal speakers, and herein each of the ambient signal channels is fed with at least one of the ambient signal speakers.

Another embodiment may have a method for rendering an audio content represented by a multi-channel input audio signal, including: providing ambient signal channels on the basis of an input audio signal, wherein the method includes acquiring the ambient signal channels such that ambient signal components are distributed among the ambient signal channels in dependence on positions or directions of sound sources within the input audio signal, wherein a number of acquired ambient signal channels including different audio content is larger than a number of channels of the input audio signal; wherein the method includes acquiring a direct signal, which includes direct sound components, on the basis of the input audio signal; wherein the method includes extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal; wherein a direct signal is acquired on the basis of the input audio signal; wherein spectral weights are applied, in order to distribute the ambient signal to the ambient signal channels; wherein a same set of spectral weights is applied for distributing direct signal components to direct signal channels and for distributing ambient signal components of the ambient signal to ambient signal channels, wherein more than 2 ambient signal channels are provided; providing more than 2 direct signal channels; feeding the ambient signal channels and the direct signal channels to a speaker arrangement including a set of direct signal speakers and a set of ambient signal speakers, wherein each of the direct signal channels is fed to at least one of the direct signal speakers, and wherein each of the ambient signal channels is fed with at least one of the ambient signal speakers.

According to another embodiment, a non-transitory digital storage medium may have a computer program stored thereon to perform the method for providing ambient signal channels on the basis of an input audio signal, wherein the method includes acquiring the ambient signal channels such that ambient signal components are distributed among the ambient signal channels in dependence on positions or directions of sound sources within the input audio signal, wherein a number of acquired ambient signal channels including different audio content is larger than a number of channels of the input audio signal; wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels, when said computer program is run by a computer.

According to another embodiment, a non-transitory digital storage medium may have a computer program stored thereon to perform the method for providing ambient signal channels on the basis of an input audio signal, wherein the method includes acquiring the ambient signal channels such that ambient signal components are distributed among the ambient signal channels in dependence on positions or directions of sound sources within the input audio signal, wherein a number of acquired ambient signal channels including different audio content is larger than a number of channels of the input audio signal; wherein the method includes acquiring a direct signal, which includes direct sound components, on the basis of the input audio signal; wherein the method includes extracting an ambient signal on the basis of the input audio signal; and wherein the method includes distributing the ambient signal to a plurality of ambient signal channels in dependence on positions or directions of sound sources within the input audio signal, wherein a number of ambient signal channels is larger than a number of channels of the input audio signal; wherein the ambient signal channels are associated with different directions; wherein direct signal channels are associated with different directions, wherein the ambient signal channels and the direct signal channels are associated with the same set of directions, or wherein the ambient signal channels are associated with a subset of the set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using the same panning coefficients or spectral weights using which the direct signal components are distributed, when said computer program is run by a computer.

According to another embodiment, a non-transitory digital storage medium may have a computer program stored thereon to perform the method for providing ambient signal channels on the basis of an input audio signal, wherein the method includes acquiring the ambient signal channels such that ambient signal components are distributed among the ambient signal channels in dependence on positions or directions of sound sources within the input audio signal, wherein a number of acquired ambient signal channels including different audio content is larger than a number of channels of the input audio signal; wherein the method includes acquiring a direct signal, which includes direct sound components, on the basis of the input audio signal; wherein the method includes extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal; wherein a direct signal is acquired on the basis of the input audio signal; wherein spectral weights are applied, in order to distribute the ambient signal to the ambient signal channels; wherein a same set of spectral weights is applied for distributing direct signal components to direct signal channels and for distributing ambient signal components of the ambient signal to ambient signal channels, when said computer program is run by a computer.

Another embodiment may have a system for rendering an audio content represented by a multi-channel input audio signal, including: an audio signal processor for providing ambient signal channels on the basis of an input audio signal, wherein the audio signal processor is configured to obtain the ambient signal channels, wherein a number of obtained ambient signal channels including different audio content is larger than a number of channels of the input audio signal; wherein the audio signal processor is configured to obtain the ambient signal channels such that ambient signal components are distributed among the ambient signal channels in dependence on positions or directions of sound sources within the input audio signal; wherein the audio signal processor is configured to provide more than 2 direct signal channels and more than 2 ambient signal channels; and a speaker arrangement i a set of direct signal speakers and a set of ambient signal speakers, wherein each of the direct signal channels is associated to at least one of the direct signal speakers, and wherein each of the ambient signal channels is associated with at least one of the ambient signal speakers, such that direct signals and ambient signals are rendered using different speakers.

An embodiment according to the invention creates an audio signal processor for providing ambient signal channels on the basis of an input audio signal. The audio signal processor is configured to obtain the ambient signal channels, wherein a number of obtained ambient signal channels comprising different audio content is larger than a number of channels of the input audio signal. The audio signal processor is configured to obtain the ambient signal channels such that ambient signal components are distributed among the ambient signal channels in dependence on positions or directions of sound sources within the input audio signal.

This embodiment according to the invention is based on the finding that it is desirable to have a number of ambient signal channels which is larger than a number of channels of the input audio signal and that it is advantageous in such a case to consider positions or directions of the sound sources when providing the ambient signal channels. Accordingly, the contents of the ambient signals can be adapted to audio contents represented by the input audio signal. For example, ambient audio contents can be included in different of the ambient signal channels, wherein the ambient audio contents included into the different ambient signal channels may be determined on the basis of an analysis of the input audio signal. Accordingly, the decision into which of the ambient signal channels to include which ambient audio content may be made dependent on positions or directions of sound sources (for example, direct sound sources) exciting the different ambient audio content.

Accordingly, there may be embodiments in which there is first a direction-based decomposition (or upmixing) of the input audio signals and then a direct/ambience decomposition. However, there are also embodiments in which there is first a direct/ambience decomposition, which is followed by an upmixing of extracted ambience signal components (for example, into ambience channel signals). Also, there are embodiments in which there may be a combined upmixing and ambient signal extraction (or direct/ambient decomposition).

In an advantageous embodiment, the audio signal processor is configured to obtain the ambient signal channels such that the ambient signal components are distributed among the ambient signal channels according to positions or directions of direct sound sources exciting the respective ambient signal components. Accordingly, a good hearing impression can be achieved, and it can be avoided that ambient signal channels comprise ambient audio contents which do not fit the audio contents of direct sound sources at a given position or in a given direction. In other words, it can be avoided that an ambient sound is rendered in an audio channel which is associated with a position or direction from which no direct sound exciting the ambient sound arrives. It has been found that uniformly distributing ambient sound can sometimes result in dissatisfactory hearing impression, and that such dissatisfactory hearing impression can be avoided by using the concept to distribute ambient signal components ccording to positions or directions of direct sound sources exciting the respective ambient signal components.

In an advantageous embodiment, the audio signal processor is configured to distribute the one or more channels of the input audio signal to a plurality of upmixed channels, wherein a number of upmixed channels is larger than the number of channels of the input audio signal. Also, the audio signal processor is configured to extract the ambient signal channels from upmixed channels. Accordingly, an efficient processing can be obtained, since simple a joint upmixing for direct signal components and ambient signal components is performed. A separation between ambient signal components and direct signal components is performed after the upmixing (distribution of the one or more channels of the input audio signal to the plurality of upmixed channels). Consequently, it can be achieved, with moderate effort, that ambient signals originate from similar directions like direct signals exciting the ambient signals.

In an advantageous embodiment, the audio signal processor is configured to extract the ambient signal channels from the upmixed channels using a multi-channel ambient signal extraction or using a multi-channel direct-signal/ambient signal separation. Accordingly, the presence of multiple channels can be exploited in the ambient signal extraction or direct-signal/ambient signal separation. In other words, it is possible to exploit similarities and/or differences between the upmixed channels to extract the ambient signal channels, which facilitates the extraction of the ambient signal channels and brings along good results (for example, when compared to a separate ambient signal extraction on the basis of individual channels).

In an advantageous embodiment, the audio signal processor is configured to determine upmixing coefficients and to determine ambient signal extraction coefficients. Also, the the audio signal processor is configured to obtain the ambient signal channels using the upmixing coefficients and the ambient signal extraction coefficients. Accordingly, it is possible to derive the ambient signal channels in a single processing step (for example, by deriving a signal processing matrix on the basis of the upmixing coefficients and the ambient signal extraction coefficients).

An embodiment according to the invention (which may optionally comprise one or more of the above described features) creates an audio signal processor for providing ambient signal channels on the basis of an input audio signal (which may, for example, be a multichannel input audio signal). The audio signal processor is configured to extract an ambient signal on the basis of the input audio signal.

For example, the audio signal processor may be configured to perform a direct-ambient-separation or a direct-ambient decomposition on the basis of the input audio signal, in order to derive ("extract") the (intermediate) ambient signal, or the audio signal processor may be configured to perform an ambient signal extraction in order to derive the ambient signal. For example, the direct-ambient separation or direct-ambient decomposition or ambient signal extraction may be performed alternatively. For example, the ambient signal may be a multichannel signal, wherein the number of channels of the ambient signal may, for example, be identical to the number of channels of the input audio signal.

Moreover, the signal processor is configured to distribute (or to "upmix") the (extracted) ambient signal to a plurality of ambient signal channels, wherein a number of ambient signal channels (for example, of ambient signal channels having different signal content) is larger than a number of channels of the input audio signal (and/or, for example, larger than a number of channels of the extracted ambient signal), in dependence on positions or directions of sound sources (for example, of direct sound sources) within the input audio signal.

In other words, the audio signal processor may be configured to consider directions or positions of sound sources (for example, of direct sound sources) within the input audio signal when upmixing the extracted ambient signal to a higher number of channels.

Accordingly, the ambient signal is not "uniformly" distributed to the ambient signal channels, but positions or directions of sound sources, which may underlie (or generate, or excite) the ambient signal(s), are taken into consideration.

It has been found that such a concept, in which ambient signals are not distributed arbitrarily to the ambient signal channels (wherein a number of ambient signal channels is larger than a number of channels of the input audio signal) but dependent on positions or directions of sound sources within the input audio signal provides a more favorable hearing impression in many situations. For example, distributing ambient signals uniformly to all ambient signal channels may result in very unnatural or confusing hearing impression. For example, it has been found that this is the case if a direct sound source can be clearly allocated to a certain direction of arrival, while the echo of said sound source (which is an ambient signal) is distributed to all ambient signal channels.

To conclude, it has been found that a hearing impression, which is caused by an ambient signal comprising a plurality of ambient signal channels, is often improved if the position or direction of a sound source, or of sound sources, within an input audio signal, from which the ambient signal channels are derived, is considered in a distribution of an extracted ambient signal to the ambient signal channels, because a non-uniform distribution of the ambient signal contents within the input audio signal (in dependence on positions or directions of sound sources within the input audio signal) better reflects the reality (for example, when compared to uniform or arbitrary distribution of the ambient signals without consideration of positions or directions of sound sources in the input audio signal).

In an advantageous embodiment, the audio signal processor is configured to perform a direct-ambient separation (for example, a decomposition of the audio signal into direct sound components and ambient sound components, which may also be designated as direct-ambient-decomposition) on the basis of the input audio signal, in order to derive the (intermediate) ambient signal. Using such a technique, both an ambient signal and a direct signal can be obtained on the basis of the input audio signal, which improves the efficiency of the processing, since typically both the direct signal and the ambient signal are needed for the further processing.

In an advantageous embodiment, the audio signal processor is configured to distribute ambient signal components (for example, of the extracted ambient signal, which may be a multi-channel ambient signal) among the ambient signal channels according to positions or directions of direct sound sources exciting respective ambient signal components (where a number of the ambient signal channels may, for example, be larger than a number of channels of the input audio signal and/or larger than a number of channels of the extracted ambient signal). Accordingly, the position or direction of direct sound sources exciting the ambient signal components may be considered, whereby, for example, different ambient signal components excited by different direct sources located at different positions may be distributed differently among the ambient signal channels. For example, ambient signal components excited by a given direct sound source may be primarily distributed to one or more ambient signal channels which are associated with one or more direct signal channels to which direct signal components of the respective direct sound source are primarily distributed. Thus, the distribution of ambient signal components to different ambient signal channels may correspond to a distribution of direct signal components exciting the respective ambient signal components to different direct signal channels. Consequently, in a rendering environment, the ambient signal components may be perceived as originating from the same or similar directions like the direct sound sources exciting the respective ambient signal components. Thus, an unnatural hearing impression may be avoided in some cases. For example, it can be avoided that an echo signal arrives from a completely different direction when compared to the direct sound source exciting the echo, which would not fit some desired synthesized hearing environments.

In an advantageous embodiment, the ambient signal channels are associated with different directions. For example, the ambient signal channels may be associated with the same directions as corresponding direct signal channels, or may be associated with similar directions like the corresponding direct signal channels. Thus, the ambient signal components can be distributed to the ambient signal channels such that it can be achieved that the ambient signal components are perceived to originate from a certain direction which correlates with a direction of a direct sound source exciting the respective ambient signal components.

In an advantageous embodiment, the direct signal channels are associated with different directions, and the ambient signal channels and the direct signal channels are associated with the same set of directions (for example, at least with respect to an azimuth direction, and at least within a reasonable tolerance of, for example, +/−20° or +/−10°). Moreover, the audio signal processor is configured to distribute direct signal components among direct signal channels (or, equivalently, to pan direct signal components to direct signal channels) according to positions or directions of respective direct sound components. Moreover, the audio signal processor is configured to distribute the ambient signal components (for example, of the extracted ambient signal) among the ambient signal channels according to positions or directions of direct sound sources exciting the respective ambient signal components in the same manner (for example, using the same panning coefficients or spectral weights) in which the direct signal components are distributed (wherein the ambient signal channels are advantageously different from the direct signal channels, i.e., independent channels). Accordingly, a good hearing impression can be obtained in some situations, in which it would sound unnatural to arbitrarily distribute the ambient signals without taking into consideration the (spatial) distribution of the direct signal components.

In an advantageous embodiment, the audio signal processor is configured to provide the ambient signal channels such that the ambient signal is separated into ambient signal components according to positions of source signals underlying the ambient signal components (for example, direct source signals that produced the respective ambient signal components). Accordingly, it is possible to separate different ambient signal components which are expected to originate from different direct sources. This allows for an individual handling (for example, manipulation, scaling, delaying or filtering) of direct sound signals and ambient signals excited by different sources.

In an advantageous embodiment, the audio signal processor is configured to apply spectral weights (for example, time-dependent and frequency-dependent spectral weights) in order to distribute (or upmix or pan) the ambient signal to the ambient signal channels (such that the processing is effected in the time-frequency domain). It has been found that such a processing in the time-frequency domain, which uses spectral weights, is well-suited for a processing of cases in which there are multiple sound sources. Using this concept, a position or direction-of-arrival can be associated with each spectral bin, and the distribution of the ambient signal to a plurality of ambient signal channels can also be made spectral-bin by spectral-bin. In other words, for each spectral bin, it can be determined how the ambient signal should be distributed to the ambient signal channels. Also, the determination of the time-dependent and frequency-dependent spectral weights can correspond to a determination of positions or directions of sound sources within the input signal. Accordingly, it can easily be achieved that the ambient signal is distributed to a plurality of ambient signal channels in dependence on positions or directions of sound sources within the input audio signal.

In an advantageous embodiment, the audio signal processor is configured to apply spectral weights, which are computed to separate direct audio sources according to their positions or directions, in order to upmix (or pan) the ambient signal to the plurality of ambient signal channels. Alternatively, the audio signal processor is configured to apply a delayed version of spectral weights, which are computed to separate direct audio sources according to their positions or directions, in order to upmix the ambient signal to a plurality of ambient signal channels. It has been found that a good hearing impression can be achieved with low computational complexity by applying these spectral weights, which are computed to separate direct audio sources according to their positions or directions, or a delayed version thereof, for the distribution (or up-mixing or panning) of the ambient signal to the plurality of ambient signal channels. The usage of a delayed version of the spectral weights may, for example, be appropriate to consider a time shift between a direct signal and a echo.

In an advantageous embodiment, the audio signal processor is configured to derive the spectral weights such that the spectral weights are time-dependent and frequency-dependent. Accordingly, time-varying signals of the direct sound sources and a possible motion of the direct sound sources can be considered. Also, varying intensities of the direct sound sources can be considered. Thus, the distribution of the ambient signal to the ambient signal channels is not static, but the relative weighting of the ambient signal in a plurality of (upmixed) ambient signal channels varies dynamically.

In an advantageous embodiment, the audio signal processor is configured to derive the spectral weight in dependence on positions of sound sources in a spatial sound image of the input audio signal. Thus, the spectral weight well-reflects the positions of the direct sound sources exciting the ambient signal, and it is therefore easily possible that ambient signal components excited by a specific sound source can be associated to the proper ambient signal channels which correspond to the direction of the direct sound source (in a spatial sound image of the input audio signal).

In an advantageous embodiment, the input audio signal comprises at least two input channel signals, and the audio signal processor is configured to derive the spectral weights in dependence on differences between the at least two input channel signals. It has been found that differences between the input channel signals (for example, phase differences and/or amplitude differences) can be well-evaluated for obtaining an information about a direction of a direct sound source, wherein it is advantageous that the spectral weights correspond at least to some degree to the directions of the direct sound sources.

In an advantageous embodiment, the audio signal processor is configured to determine the spectral weights in dependence on positions or directions from which the spectral components (for example, of direct sound components in the input signal or in the direct signal) originate, such that spectral components originating from a given position or direction (for example, from a position p) are weighted stronger in a channel (for example, of the ambient signal channels) associated with the respective position or direction when compared to other channels (for example, of the ambient signal channels). In other words, the spectral weights are determined to distinguish (or separate) ambient signal components in dependence on a direction from which direct sound components exciting the ambient signal components originate. Thus, it can, for example, be achieved that ambient signals originating from different sounds sources are distributed to different ambient signal channels, such that the different ambient signal channels typically have a different weighting of different ambient signal components (e.g. of different spectral bins).

In an advantageous embodiment, the audio signal processor is configured to determine the spectral weights such that the spectral weights describe a weighting of spectral components of input channel signals (for example, of the input signal) in a plurality of output channel signals. For example, the spectral weights may describe that a given input channel signal is included into a first output channel signal with a strong weighting and that the same input channel signal is included into a second output channel signal with a smaller weighting. The weight may be determined individually for different spectral components. Since the input signal may, for example, be a multi-channel signal, the spectral weights may describe the weighting of a plurality of input channel signals in a plurality of output channel signals, wherein there are typically more output channel signals than input channel signals (up-mixing). Also, it is possible that signals from a specific input channel signal are never taken over in a specific output channel signal. For example, there may be no inclusion of any input channel signals which are associated to a left side of a rendering environment into output channel signals associated with a right side of a rendering environment, and vice versa.

In an advantageous embodiment, the audio signal processor is configured to apply a same set of spectral weights for distributing direct signal components to direct signal channels and for distributing ambient signal components of the ambient signal to ambient signal channels (wherein a time delay may be taken into account when distributing the ambient signal components). Accordingly, the ambient signal components may be distributed to ambient signal channels in the same manner as direct signal components are allocated to direct signal channels. Consequently, in some cases, the ambient signal components all fit the direct signal components and a particularly good hearing impressions achieved.

In an advantageous embodiment, the input audio signal comprises at least two channels and/or the ambient signal comprises at least two channels. It should be noted that the concept discussed herein is particularly well-suited for input audio signals having two or more channels, because such input audio signals can represent a location (or direction) of signal components.

An embodiment according to the invention creates a system for rendering an audio content represented by a multi-channel input audio signal. The system comprises an audio signal processor as described above, wherein the audio signal processor is configured to provide more than two direct signal channels and more than two ambient signal channels. Moreover, the system comprises a speaker arrangement comprising a set of direct signal speakers and a set of ambient signal speakers. Each of the direct signal channels is associated to at least one of the direct signal speakers, and each of the ambient signal channels is associated with at least one of the ambient signal speakers. Accordingly, direct signals and ambient signals may, for example, be rendered using different speakers, wherein there may, for example, be a spatial correlation between direct signal speakers and corresponding ambient signal speakers. Accordingly, both the direct signals (or direct signal components) and the ambient signals (or ambient signal components) can be up-mixed to a number of speakers which is larger than a number of channels of the input audio signal. The ambient signals or ambient signal components are also rendered by multiple speakers in a non-uniform manner, distributed to the different ambient signal speakers in accordance with directions in which sound sources are arranged. Consequently, a good hearing impression can be achieved.

In an advantageous embodiment, each ambient signal speaker is associated with one direct signal speaker. Accordingly, a good hearing impression can be achieved by distributing the ambient signal components over the ambient signal speakers in the same manner in which the direct signal components are distributed over the direct signal speakers.

In an advantageous embodiment, positions of the ambient signal speakers are elevated with respect to positions of the direct signal speakers. It has been found that a good hearing impression can be achieved by such a configuration. Also, the configuration can be used, for example, in a vehicle and provide a good hearing impression in such a vehicle.

An embodiment according to the invention creates a method for providing ambient signal channels on the basis of an input audio signal (which may, advantageously, be a multi-channel input audio signal). The method comprises extracting an ambient signal on the basis of the input audio signal (which may, for example, comprise performing a direct-ambient separation or a direct-ambient composition on the basis of the input audio signal, in order to derive the ambient signal, or a so-called "ambient signal extraction").

Moreover, the method comprises distributing (for example, up-mixing) the ambient signal to a plurality of ambient signal channels, wherein a number of ambient signal channels (which may, for example, have associated different signal content) is larger than a number of channels of the input audio signal (for example, larger than a number of channels of the extracted ambient signal), in dependence on positions or directions of sounds sources within the input audio signal. This method is based on the same considerations as the above-described apparatus. Also, it should be noted that the method can be supplemented by any of the features, functionalities and details described herein with respect to corresponding apparatus.

Another embodiment comprises a method of rendering an audio content represented by a multi-channel input audio signal. The method comprises providing ambient signal channels on the basis of an input audio signal, as described above. In this case, more than two ambient signal channels are provided. Moreover, the method also comprises providing more than two direct signal channels. The method also comprises feeding the ambient signal channels and the direct signal channels to a speaker arrangement comprising a set of direct signal speakers and a set of ambient signal speakers, wherein each of the direct signal channels is fed to at least one of the direct signal speakers, and wherein each of the ambient signal channels is fed to at least one of the ambient signal speakers. This method is based on the same considerations as the above-described system. Also, it should be noted that the method can be supplemented by any features, functionalities and details described herein with respect to the above-mentioned system.

Another embodiment according to the invention creates a computer program for performing one of the methods mentioned before when the computer program runs on a computer.

BRIEF DESCRIPTION OF THE DRAWINGS

Embodiments of the present invention will be detailed subsequently referring to the appended drawings, in which.

DETAILED DESCRIPTION OF THE INVENTION

1. Audio signal Processor According to FIG. 1*a* and FIG. 1*b*

Figure 1A:
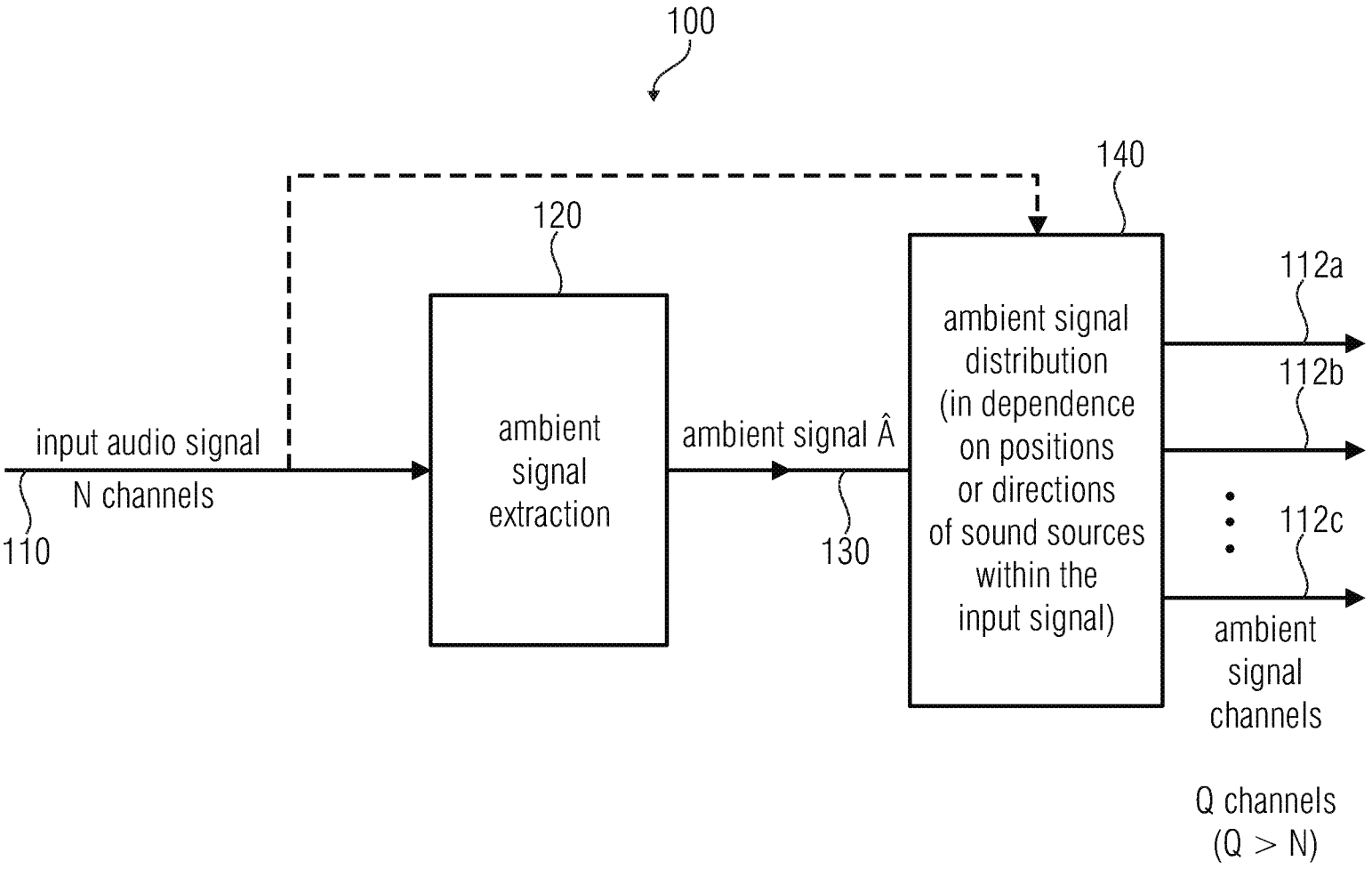
FIG. 1*a* shows a block schematic diagram of an audio signal processor, according to an embodiment of the present invention.

1a) Audio Signal Processor According to FIG. 1*a*.

FIG. 1*a* shows a block schematic diagram of an audio signal processor, according to an embodiment of the present invention. The audio signal processor according to FIG. 1*a* is designated in its entirety with 100.

The audio signal processor 100 receives an input audio signal 110, which may, for example, be a multi-channel input audio signal. The input audio signal 110 may, for example, comprise N channels. Moreover, the audio signal processor 100 provides ambient signal channels 112*a*, 112*b*, 112*c* on the basis of the input audio signal 110.

The audio signal processor 100 is configured to extract an ambient signal 130 (which also may be considered as an intermediate ambient signal) on the basis of the input audio signal 110. For this purpose, the audio signal processor may, for example, comprise an ambient signal extraction 120. For example, the ambient signal extraction 120 may perform a direct-ambient separation or a direct ambient decomposition on the basis of the input audio signal 110, in order to derive the ambient signal 130. For example, the ambient signal extraction 120 may also provide a direct signal (e.g. an estimated or extracted direct signal), which may be designated with $\hat{D}$, and which is not shown in FIG. 1*a*. Alternatively, the ambient signal extraction may only extract the ambient signal 130 from the input audio signal 120 without providing the direct signal. For example, the ambient signal extraction 120 may perform a "blind" direct-ambient separation or direct-ambient decomposition or ambient signal extraction. Alternatively, however, the ambient signal extraction 120 may receive parameters which support the direct ambient separation or direct ambient decomposition or ambient signal extraction.

Moreover, the audio signal processor 100 is configured to distribute (for example, to upmix) the ambient signal 130 (which can be considered as an intermediate ambient signal) to the plurality of ambient signal channels 112*a*, 112*b*, 112*c*, wherein the number of ambient signal channels 112*a*, 112*b*, 112*c* is larger than the number of channels of the input audio signal 110 (and typically also larger than a number of channels of the intermediate ambient signal 130). It should be noted that the functionality to distribute the ambient signal 130 to the plurality of ambient signal channels 112*a*, 112*b*, 112*c* may, for example, be performed by an ambient signal distribution 140, which may receive the (intermediate) ambient signal 130 and which may also receive the input audio signal 110, or an information, for example, with respect to positions or directions of sound sources within the input audio signal. Also, it should be noted that the audio signal processor is configured to distribute the ambient signal 130 to the plurality of ambient signal channels in dependence on positions or directions of sound sources within the input audio signal 110. Accordingly, the ambient signal channels 112*a*, 112*b*, 112*c* may, for example, comprise different signal contents, wherein the distribution of the (intermediate) ambient signal 130 to the plurality of ambient signal channels 112*a*, 112*b*, 112*c* may also be time dependent and/or frequency dependent and reflect varying positions and/or varying contents of the sound sources underlying the input audio signal.

To conclude, the audio signal processor 110 may extract the (intermediate) ambient signal 130 using the ambient signal extraction, and may then distribute the (intermediate) ambient signal 130 to the ambient signal channels 112*a*, 112*b*, 112*c*, wherein the number of ambient signal channels is larger than the number of channels of the input audio signal. The distribution of the (intermediate) ambient signal 130 to the ambient signal channels 112*a*, 112*b*, 112*c* may not be defined statically, but may adapt to time-variant positions or directions of sound sources within the input audio signal. Also, the signal components of the ambient signal 130 may be distributed over the ambient signal channels 112*a*, 112*b*, 112*c* in such a manner that the distribution corresponds to positions or directions of direct sound sources exciting the ambient signals.

Accordingly, the different ambient signal channels 112*a*, 112*b*, 112*c* may, for example, comprise different ambient signal components, wherein one of the ambient signal channels may, predominantly, comprise ambient signal components originating from (or excited by) a first direct sound source, and wherein another of the ambient signal channels may, predominantly, comprise ambient signal components originating from (or excited by) another direct sound source.

To conclude, the audio signal processor 100 according to FIG. 1*a* may distribute ambient signal components originating from different direct sound sources to different ambient signal channels, such that, for example, the ambient signal components may be spatially distributed.

This can bring along improved hearing impression in some situations It can be avoided that ambient signal components are rendered via ambient signal channels that are associated to directions which "absolutely do not fit" a direction from which the direct sound originates.

Moreover, it should be noted that the audio signal processor according to FIG. 1*a* can be supplemented by any features, functionalities and details described herein, both individually and taken in combination.

Figure 1B:
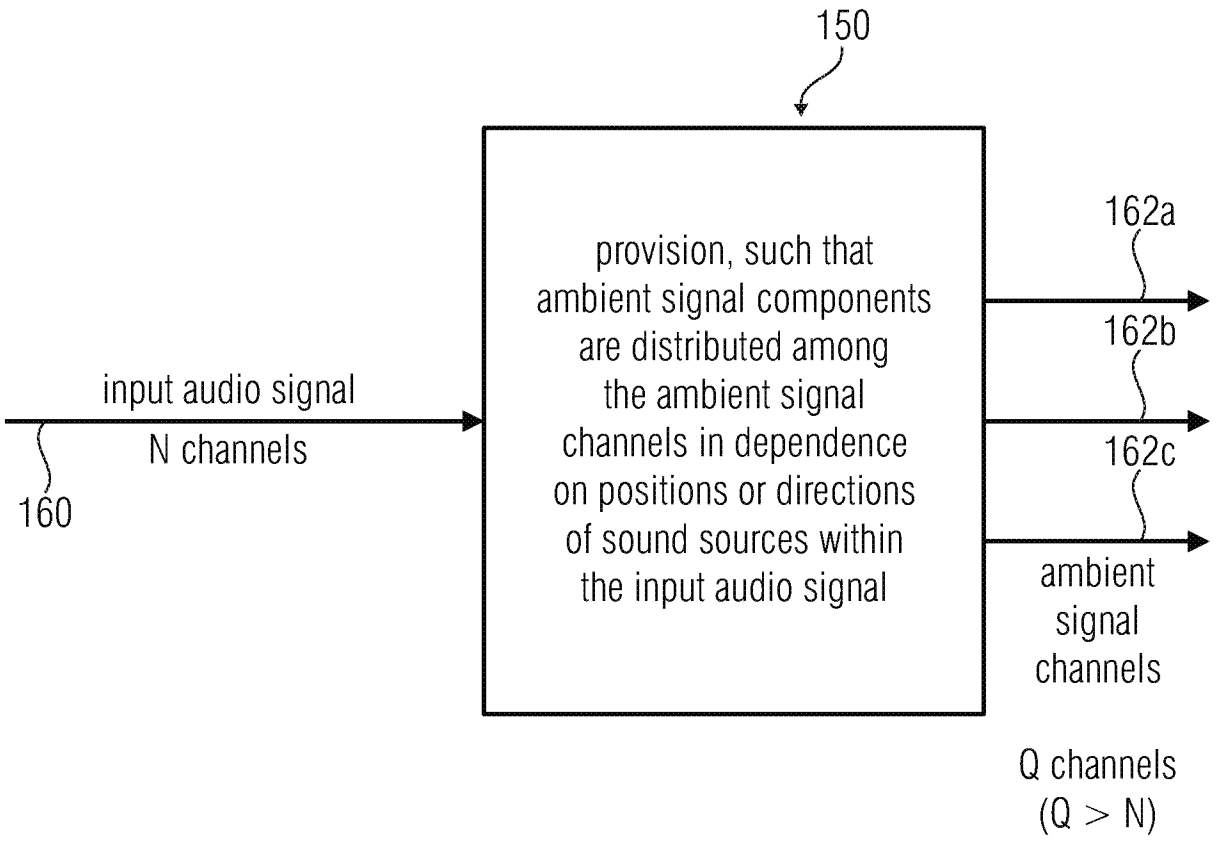
FIG. 1*b* shows a block schematic diagram of an audio signal processor, according to an embodiment of the present invention.

1b) Audio Signal Processor According to FIG. 1*b*

FIG. 1*b* shows a block schematic diagram of an audio signal processor, according to an embodiment of the present invention. The audio signal processor according to FIG. 1*b* is designated in its entirety with 150.

The audio signal processor 150 receives an input audio signal 160, which may, for example, be a multi-channel input audio signal. The input audio signal 160 may, for example, comprise N channels. Moreover, the audio signal processor 150 provides ambient signal channels 162*a*, 162*b*, 162*c* on the basis of the input audio signal 160.

The audio signal processor 150 is configured to provide the ambient signal channels such that ambient signal components are distributed among the ambient signal channels in dependence on positions or directions of sound sources within the input audio signal.

This audio signal processor brings along the advantage that the ambient signal channels are well adapted to direct signal contents, which may be included in direct signal channels. For further details, reference is made to the above explanations in the section "summary of the invention", and also to the explanations regarding the other embodiments.

Moreover, it should be noted that the signal processor 150 can optionally be supplemented by any features, functionalities and details described herein.

Figure 2:
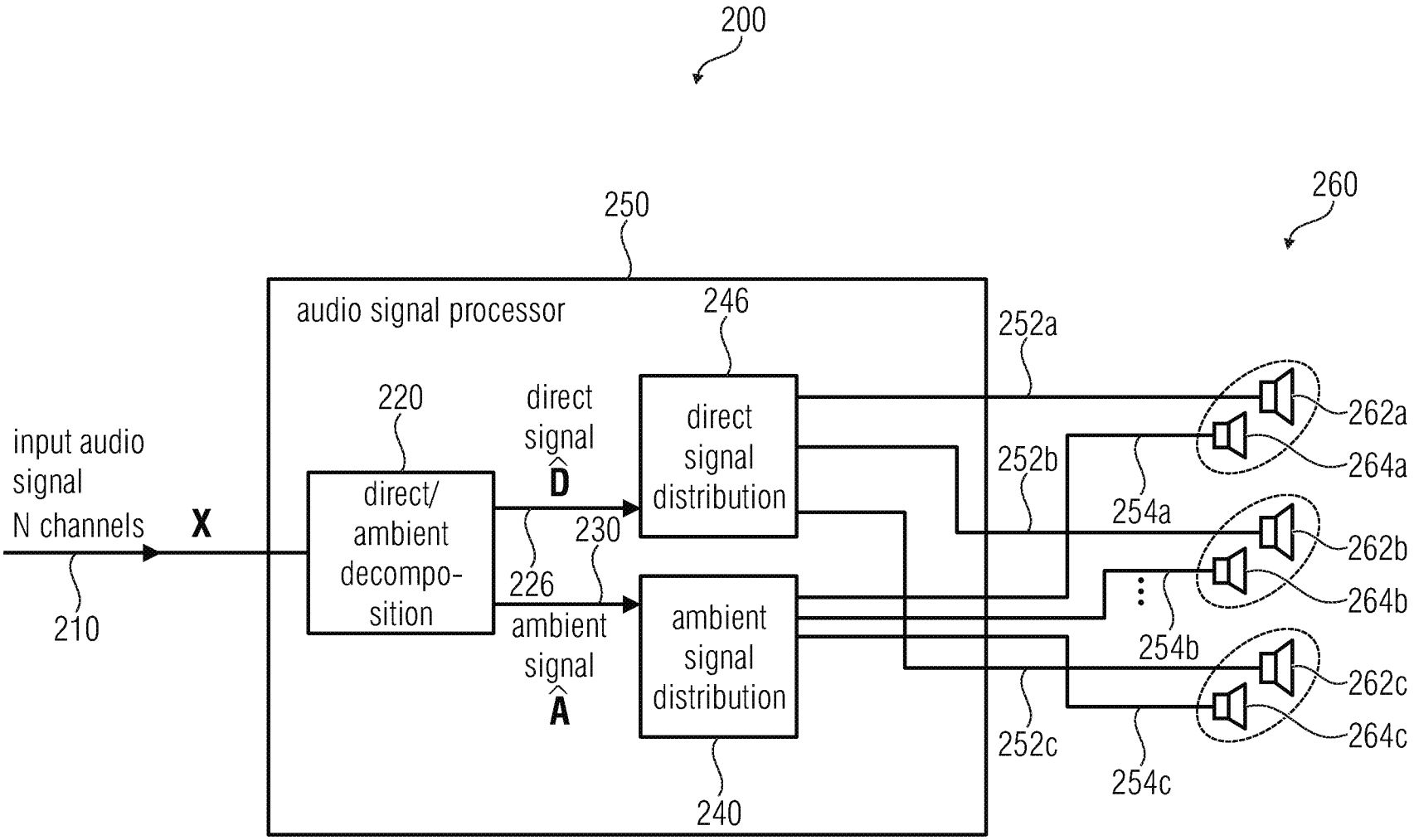
FIG. 2 shows a block schematic diagram of a system, according to an embodiment of the present invention.

2) System According to FIG. 2

FIG. 2 shows a block schematic diagram of a system, according to an embodiment of the present invention. The system is designated in its entirety with 200. The system 200 is configured to receive a multi-channel input audio signal 210, which may correspond to the input audio signal 110. Moreover, the system 200 comprises an audio signal processor 250, which may, for example, comprise the functionality of the audio signal processor 100 as described with reference to FIG. 1*a* or FIG. 1*b*. However, it should be noted that the audio signal processor 250 may have an increased functionality in some embodiments.

Moreover, the system also comprises a speaker arrangement 260 which may, for example, comprise a set of direct signal speakers 262*a*, 262*b*, 262*c* and a set of ambient signal speakers 264*a*, 264*b*, 264*c*. For example, the audio signal processor may provide a plurality of direct signal channels 252*a*, 252*b*, 252*c* to the direct signal speakers 262*a*, 262*b*, 262*c*, and the audio signal processor 250 may provide ambient signal channels 254*a*, 254*b*, 254*c* to the ambient signal speakers 264*a*, 264*b*, 264*c*. For example, the ambient signal channels 254*a*, 254*b*, 254*c* may correspond to the ambient signal channels 112*a*, 112*b*, 112*c*.

Thus, generally speaking, it can be said that the audio signal processor 250 provides more than two direct signal channels 252*a*, 252*b*, 252*c* and more than two ambient signal channels 254*a*, 254*b*, 254*c*. Each of the direct signal channels 252*a*, 252*b*, 252*c* is associated to at least one of the direct signal speakers 262*a*, 262*b*, 262*c*. Also, each of the ambient signal channels 254*a*, 254*b*, 254*c* is associated with at least one of the ambient signal speakers 264*a*, 264*b*, 264*c*.

In addition, there may, for example, be an association (for example, a pairwise association) between direct signal speakers and ambient signal speakers. Alternatively, however, there may be an association between a subset of the direct signal speakers and the ambient signal speakers. For example, there may be more direct signal speakers than ambient signal speakers (for example, 6 direct signal speakers and 4 ambient signal speakers). Thus, only some of the direct signal speakers may have associated ambient signal speakers, while some other direct signal speakers do not have associated ambient signal speakers. For example, the ambient signal speaker 264*a* may be associated with the direct signal speaker 262*a*, the ambient signal speaker 264*b* may be associated with the direct signal speaker 262*b*, and the ambient signal speaker 264*c* may be associated with the direct signal speaker 262*c*. For example, associated speakers may be arranged at equal or similar azimuthal positions (which may, for example, differ by no more than 20° or by no more than 10° when seen from a listener's position). However, associated speakers (e.g. a direct signal speaker and its associated ambient signal speaker may comprise different elevations.

In the following, some details regarding the audio signal processor 250 will be explained. The audio signal processor 250 comprises a direct-ambient decomposition 220, which may, for example, correspond to the ambient signal extraction 120. The direct-ambient decomposition 220 may, for example, receive the input audio signal 210 and perform a blind (or, alternatively, guided) direct-ambient decomposition (wherein a guided direct-ambient decomposition receives and uses parameters from an audio encoder describing, for example, energies corresponding to direct components and ambient components in different frequency bands or sub-bands), to thereby provide an (intermediate) direct signal (which can also be designated with $\hat{D}$), and an (intermediate) ambient signal 230, which may, for example, correspond to the (intermediate) ambient signal 130 and which may, for example, be designated with $\hat{A}$. The direct signal 226 may, for example, be input into a direct signal distribution 246, which distributes the (intermediate) direct signal 226 (which may, for example, comprise two channels) to the direct signal channels 252*a*, 252*b*, 252*c*. For example, the direct signal distribution 246 may perform an up-mixing. Also, the direct signal distribution 246 may, for example, consider positions (or directions) of direct signal sources when up-mixing the (intermediate) direct signal 226 from the direct-ambient decomposition 226 to obtain the direct signal channels 252*a*, 252*b*, 252*c*. The direct signal distribution 246 may, for example, derive information about the positions or directions of the sound sources from the input audio signal 210, for example, from differences between different channels of the multi-channel input audio signal 210.

The ambient signal distribution 240, which may, for example, correspond to the ambient signal distribution 140, will distribute the (intermediate) ambient signal 230 to the ambient signal channels 254*a*, 254*b* and 254*c*. The ambient signal distribution 240 may also perform an up-mixing, since the number of channels of the (intermediate) ambient signal 230 is typically smaller than the number of the ambient signal channels 254*a*, 254*b*, 254*c*.

The ambient signal distribution 240 may also consider positions or directions of sound sources within the input audio signal 210 when performing the up-mixing functionality, such that the components of the ambient signal are also distributed spatially (since the ambient signal channels 254*a*, 254*b*, 254*c* are typically associated with different rendering positions).

Moreover, it should be noted that the direct signal distribution 246 and the ambient signal distribution 240 may, for example, operate in a coordinated manner. A distribution of signal components (for example, of time frequency bins or blocks of a time-frequency-domain representation of the direct signal and of the ambient signal) may be distributed in the same manner by the direct signal distribution 246 and by the ambient signal distribution 240 (wherein there may be a time shift in the operation of the ambient signal distribution in order to properly consider a delay of the ambient signal components with respect to the direct signal components). In order words, a scaling of time-frequency bins or blocks by the direct signal distribution 246 (which may be performed if the direct signal distribution 246 operates on a time-frequency domain representation of the direct signal) may be identical to a scaling of corresponding time-frequency bins or blocks which is applied by the ambient signal distribution 246 to derive the ambient signal channels 254*a*, 254*b*, 254*c* from the ambient signal 230. Details regarding this optional functionality will be described below.

To conclude, in the system 200 according to FIG. 2, there is a separation between an (intermediate) direct signal and an (intermediate) ambient signal (which both may be multi-channel intermediate signals). Consequently, the (intermediate) direct signal and the (intermediate) ambient signal are distributed (up-mixed) to obtain respective direct signal channels and ambient signal channels. The up-mixing may correspond to a spatial distribution of direct signal components and of ambient signal components, since the direct signal channels and the ambient signal channels may be associated with spatial positions. Also, the up-mixing of the (intermediate) direct signal and of the (intermediate) ambient signal may be coordinated, such that corresponding signal components (for example, corresponding with respect to their frequency, and corresponding with respect to their time -possibly under consideration of a time shift between ambient signal components and direct signal components) may be distributed in the same manner (for example, with the same up-mixing scaling). Accordingly, a good hearing impression can be achieved, and it can be avoided that the ambient signals are perceived to originate from an appropriate position.

Moreover, it should be noted that the system 200, or the audio signal processor 250 thereof, can be supplemented by any of the features and functionalities and details described herein, either individually or in combination. Moreover, it should be noted that the functionalities described with respect to the audio signal processor 250 can also be incorporated into the audio signal processor 100 as optional extensions.

Figure 3:
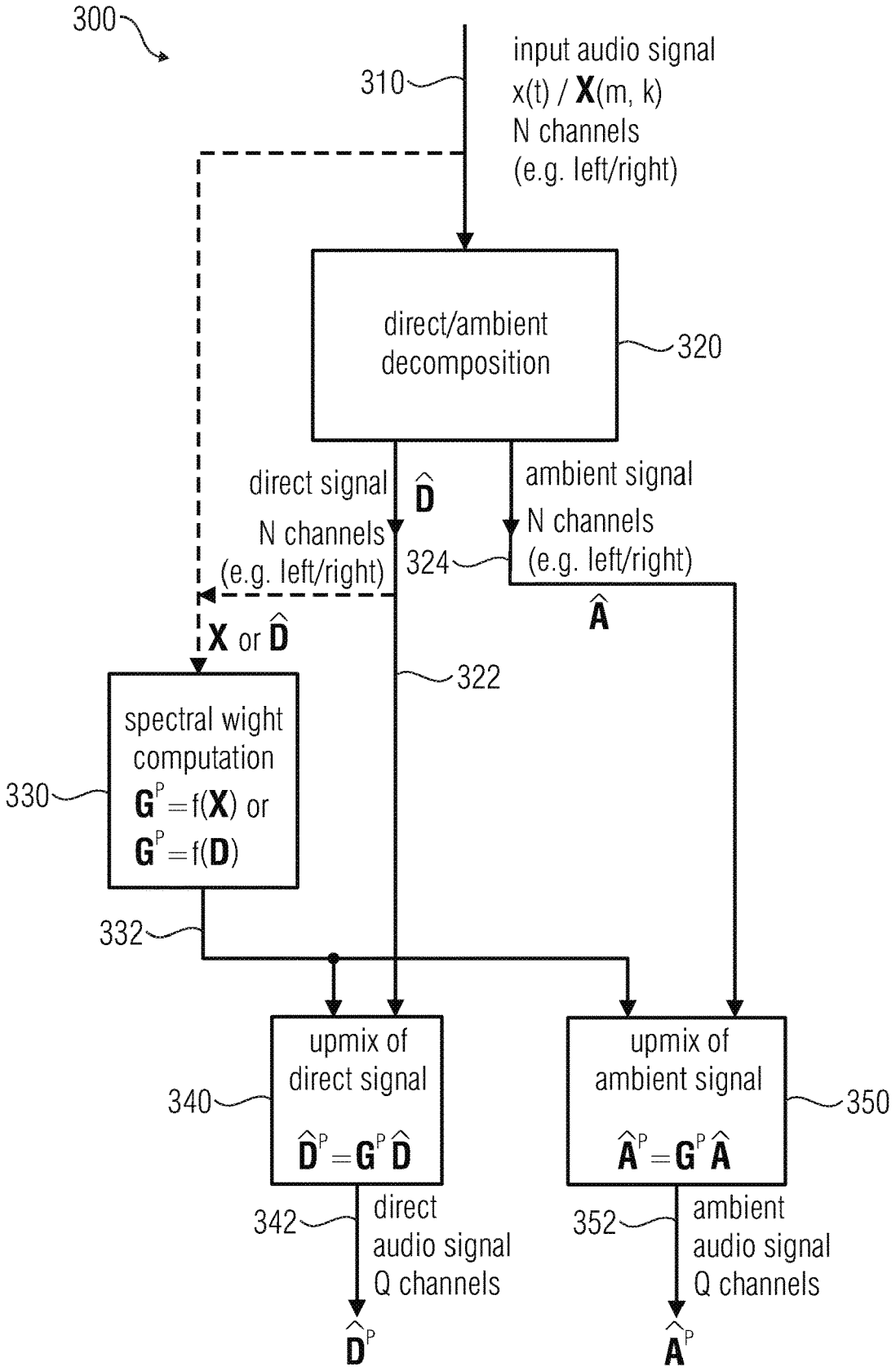
FIG. 3 shows a schematic representation of a signal flow in an audio signal processor, according to an embodiment of the present invention.
Figure 4:
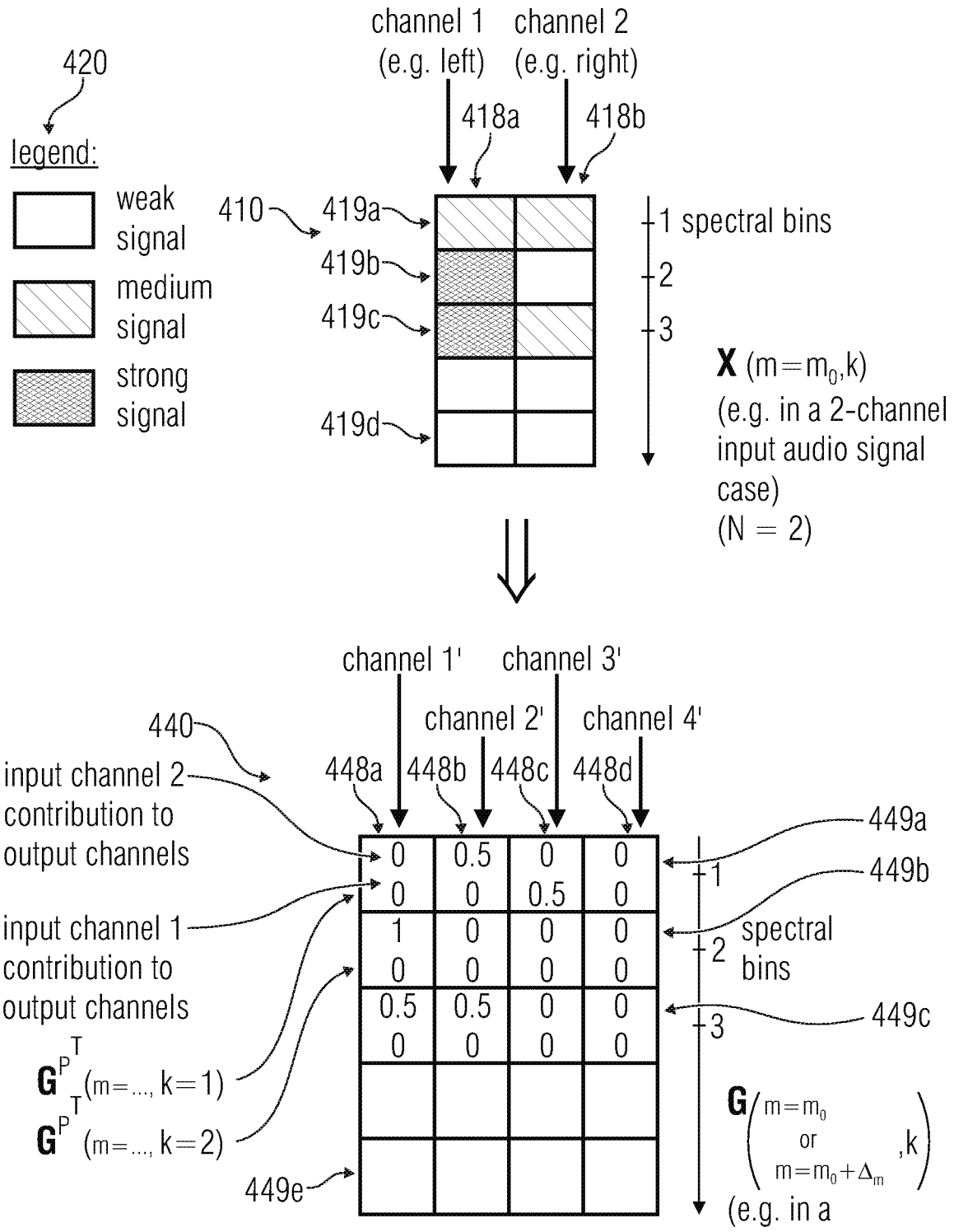
FIG. 4 shows a schematic representation of a derivation of spectral weights, according to an embodiment of the invention.

3) Signal Processing According to FIGS. 3 and 4

In the following, a signal processing will be described taking reference to FIGS. 3 and 4 which can, for example, be implemented in the audio signal processor 100 of FIG. 1*a* or in the audio signal processor according to FIG. 1*b* or in the audio signal processor 250 according to FIG. 2.

However, it should be noted that the features, functionalities, and details described in the following should be considered as being optional. Moreover, is should be noted that the features, functionalities and details described in the following, can be introduced individually or in combination into the audio signal processors 100, 250.

In the following, there will first be a description of an overall signal flow taking reference to FIG. 3. Subsequently, details regarding a spectral weight computation will be described taking reference to an example shown in FIG. 4.

Taking reference now to the signal flow of FIG. 3, it should be noted that it is assumed that there is an input audio signal 310 having N channels, wherein N is typically larger than or equal to 2. The input audio signal can also be represented as x(t), which designates a time domain representation of the input audio signal, or as X(m, k), which designates a frequency domain representation or a spectral domain representation or time-frequency domain representation of the input audio signal. For example, m is time index and k is a frequency bin (or a subband) index.

Moreover, it should be noted that, in the case that the input audio signal is in a time-domain representation, there may optionally be a time domain-to-spectral domain conversion. Also, it should be noted that the processing is advantageously performed in the spectral domain (i.e., on the basis of the signal X(m, k)).

Also, it should be noted that the input audio signal 310 may correspond to the input audio signal 110 and to the input audio signal 210.

Moreover, there is a direct/ambient decomposition 320, which is performed on the basis of the input audio signal 310. Advantageously, but not necessarily, the direct/ambient decomposition 320 is performed on the basis of the spectral domain representation X(m, k) of the input audio signal. Also, the direct/ambient decomposition may, for example, correspond to the ambient signal extraction 120 and to the direct/ambient decomposition 220.

It should further be noted that different implementations of the direct/ambient decomposition 220 are known to the man skilled in the art. Reference is made, for example, to the ambient signal separation described in PCT/EP2013/072170. However, it should be noted that any of the direct/ambient decomposition concepts known to the man skilled in the art could be used here.

Accordingly, the direct/ambient decomposition provides an (intermediate) direct signal which typically comprises N channels (just like the input audio signal 310). The (intermediate) direct signal is designated with 322, and can also be designated with $\hat{D}$. The (intermediate) direct signal may, for example, correspond to the (intermediate) direct signal 226.

Moreover, the direct/ambient decomposition 320 also provides an (intermediate) ambient signal 324, which may, for example, also comprise N channels (just like the input audio signal 310). The (intermediate) ambient signal can also be designated with $\hat{A}$.

It should be noted that the direct/ambient decomposition 320 does not necessarily provide for a perfect direct/ambient decomposition or direct/ambient separation. In other words, the (intermediate) direct signal 320 does not need to perfectly represent the original direct signal, and the (intermediate) ambient signal does not need to perfectly represent the original ambient signal. However, the (intermediate) direct signal $\hat{D}$ and the (intermediate) ambient signal$\hat{A}$ should be considered as estimates of the original direct signal and of the original ambient signal, wherein the quality of the estimation depends on the quality (and/or complexity) of the algorithm used for the direct/ambient decomposition 320. However, as is known to the man skilled in the art, a reasonable separation between direct signal components and ambient signal components can be achieved by the algorithms known from the literature.

The signal processing 300 as shown in FIG. 3 also comprises a spectral weight computation 330. The spectral weight computation 330 may, for example, receive the input audio signal 310 and/or the (intermediate) direct signal 322. It is the purpose of the spectral weight computation 330 to provide spectral weights 332 for an up-mixing of the direct signal and for an up-mixing of the ambient signal in dependence on (estimated) positions or directions of signal sources in an auditory scene. The spectral weight computation may, for example, determine these spectral weights on the basis on an analysis of the input audio signal 310. Generally speaking, an analysis of the input audio signal 310 allows the spectral weight computation 330 to estimate a position or direction from which a sound in a specific spectral bin originates (or a direct derivation of spectral weights). For example, the spectral weight computation 330 can compare (or, generally speaking, evaluate) amplitudes and/or phases of a spectral bin (or of multiple spectral bins) of channels of the input audio signal (for example, of a left channel and in a right channel). Based on such a comparison (or evaluation), (explicit or implicit) information can be derived from which position or direction the spectral component in the considered spectral bin originates. Accordingly, based on the estimation from which position or direction a sound of a given spectral bin originates, it can be concluded into which channel or channels of the (up-mixed) audio channel signal the spectral component should be up-mixed (and using which intensity or scaling). In other words, the spectral weights 332 provided by the spectral weight combination 330 may, for example, define, for each channel of the (intermediate) direct signal 322, a weighting to be used in the up-mixing 340 of the direct signal.

In other words, the up-mixing 340 of the direct signal may receive the (intermediate) direct signal 322 and the spectral weights 332 and consequently derive the direct audio signal 342, which may comprise Q channels with Q>N. Moreover, the channels of the up-mixed direct audio signals 342, may, for example, correspond to direct signal channels 252*a*, 252*b*, 252*c*. For example, the spectral weights 332 provided by the spectral weight computation 330 may define an up-mix matrix $G_p$ which defines weights associated with the N channels of the (intermediate) direct signal 322 in the computation of the Q channels of the up-mixed direct audio signal 342. The spectral weights, and consequently the up-mix matrix $G_p$ used by the up-mixing 340, may for example, differ from spectral bin to spectral bin (or between different blocs of spectral bins).

Similarly, the spectral weights 332 provided by the spectral weight computation 330 may also be used in an up-mixing 350 of the (intermediate) ambient signal 324. The up-mixing 350 may receive the spectral weights 332 and the (intermediate) ambient signal, which may comprise N channels 324, and provides, on the basis thereof, an up-mixed ambient signal 352, which may comprise Q channels with Q>N. For example, the Q channels of the upmixed ambient audio signal 352 may, for example, correspond to the ambient signal channels 254*a*, 254*b*, 254*c*. Also, the up-mixing 350 may, for example, correspond to the ambient signal distribution 240 shown in FIG. 2 and to ambient signal distribution 140 shown in FIG. 1*a* or FIG. 1*b*.

Again, the spectral weights 332 may define an up-mix matrix which describes the contributions (weights) of the N channels of the (intermediate) ambient signal 324 provided by the direct/ambient decomposition 320 in the provision of the Q channel up-mixed ambient audio signal 352.

For example, the up-mixing 340 and the up-mixing 350 may use the same up-mixing matrix $G^P$. However, the usage of different up-mix matrices could also be possible.

Again, the up-mix of the ambient signal is frequency dependent, and may be performed individually (using different up-mix matrices $G^P$ for different spectral bins or for different groups of spectral bins).

Optional details regarding a possible computation of the spectral weights, which is performed by the spectral weight computation 330, will be described in the following.

Moreover, it should be noted that the functionality as described here, for example with respect to the spectral weight computation 330, with respect to the up-mixing 340 of the direct signal and with respect to the up-mixing 350 of the ambient signal can optionally be incorporated into the embodiments according to FIGS. 1 and 2, either individually or taken in combination.

In the following, a simplified example for the computation of the spectral weights will be described taking reference to FIG. 4. However, it should be noted that the computation of spectral weights may, for example, be performed as described in WO 2013004698 A1.

However, it should be noted that different concepts for the computation of spectral weights, which are intended for an up-mixing of an N-channel signal into a Q channel signal can also be used. However, it should be noted that the spectral weights, which are conventionally applied in the up-mixing on the basis of an input audio signal are now applied in the upmixing of an ambient signal 324 provided by a direct/ambient decomposition 320 (on the basis of the input audio signal). However, the determination of the spectral weights may still be performed on the basis of the input audio signal (before the direct/ambient decomposition) or on the basis of the (intermediate) direct signal. In other words, the determination of the spectral weights may be similar or identical to a conventional determination of spectral weights, but, in the embodiments according to the present invention, the spectral weights are applied to a different type of signals, namely to the extracted ambient signal, to thereby improve the hearing impression.

In the following, a simplified example for the determination of spectral weights will be described taking reference to FIG. 4. A frequency domain representation of a two-channel input audio signal (for example, of the signal 310) is shown at reference number 410. A left column 410*a* represents spectral bins of a first channel of the input audio signal (for example, of a left channel) and a right column 418*b* represents spectral bins of a second channel (for example, of a right channel) of the input audio signal (for example, of the input audio signal 310). Different rows 419*a*-419*d* are associated with different spectral bins.

Moreover, different signal intensities are indicated by different filling of the respective fields in the representation 410, as shown in a legend 420.

In other words, the signal representation at reference numeral 410 may represent a frequency domain representation of the input audio signal X at a given time (for example, for a given frame) and over a plurality of frequency bins (having index k). For example, in a first spectral bin, shown in row 419*a*, signals of the first channel and of the second channel may have approximately identical intensities (for example, medium signal strength). This may, for example, indicate (or imply) that a sound source is approximately in front of the listener, i.e., in a center region. However, when considering a second spectral bin, which is represented in a row 419*b*, it can be seen that the signal in the first channel is significantly stronger than the signal in the second channel, which may indicate, for example, that the sound source is on a specific side (for example, on the left side) of a listener. In the third spectral bin, which is represented in row 419*c*, the signal is stronger in the first channel when compared to the second channel, wherein the difference (relative difference) may be smaller than in the second spectral bin (shown at row 419*b*). This may indicate that a sound source is somewhat offset from the center, for example, somewhat offset to the left side when seen from the perspective of the listener.

In the following, the spectral weights will be discussed. A representation of spectral weights is shown at reference numeral 440. Four columns 448*a* to 448*d* are associated with different channels of the up-mixed signal (i.e., of the up-mixed direct audio signal 342 and/or of the up-mixed ambient audio signal 352). In other words, it is assumed that Q=4 in the example shown at reference numeral 440. Rows 449*a* to 449*e* are associated with different spectral bins. However, it should be noted that each of the rows 449*a* to 449*e* comprises two rows of numbers (spectral weights). A first, upper row of numbers within each of the rows 449*a*-449*e* represents a contribution of the first channel (of the intermediate direct signal and/or of the intermediate ambient signal) to the channels of the respective up-mixed signal (for example, of the up-mixed direct audio signal or of the up-mixed ambient audio signal) for the respective spectral bin. Similarly, the second row of numbers (spectral weights) describes the contribution of the second channel of the intermediate direct signal or of the intermediate ambient signal to the different channels of the respective up-mixed signal (of the up-mixed direct audio signal and/or the up-mixed ambient audio signal) for the respective spectral bin.

It should be noted that each row 449*a*, 449*b*, 449*c*, 449*d*, 449*e* may correspond to the transposed version of an up-mixing matrix $G^p$.

In the following, some logic will be described how the up-mixing coefficients can be derived from the input audio signal. However, the following explanation should be considered as simplified examples only to facilitate the fundamental understanding of the present invention. However, it should be noted that the following examples only focus on amplitudes and leave phases unconsidered, while actual implementations may also take into consideration the phases. Furthermore, it should be noted that the used algorithms may be more elaborate, for example, as described in the referenced documents.

Taking reference now to the first spectral bin, it can be found (for example, by the spectral weight computation) that the amplitudes of the first channel and of the second channel of the input audio signal are similar, as shown in row 419*a*. Accordingly, it may be concluded, by the spectral weight computation 230, that for the first spectral bin, the first channel of the (intermediate) direct signal and/or of the (intermediate) ambient signal should contribute to the second channel (channel 2') of the up-mixed direct audio signal or of the up-mixed ambient audio signal (only). Accordingly, an appropriate spectral weight of 0.5 can be seen in the upper line of row 449*a*. Similarly, it can be concluded, by the spectral weight computation, that the second channel of the (intermediate) direct signal and/or of the intermediate ambient signal should contribute to the third channel (channel 3') of the up-mixed direct audio signal and/or of the up-mixed ambient audio signal, as can be seen from the corresponding value 0.5 in the second line of the first row 449*a*. For example, it can be assumed that the second channel (channel 2') and the third channel (channel 3') of the up-mixed direct audio signal and of the up-mixed ambient audio signal are comparatively close to a center of an auditory scene, while, for example, the first channel (channel 1') and the fourth channel (channel 4') are further away from the center of the auditory scene. Thus, if it is found by the spectral weight computation 330 that an audio source is approximately in front of a listener, the spectral weights may be chosen such that ambient signal components excited by this audio source will be rendered (or mainly rendered) in one or more channels close to the center of the audio scene.

Taking reference now to the second spectral bin, it can be seen in row 419*b* that the sound source is probably on the left side of the listener. Consequently, the spectral weight computation 330 may chose the spectral weights such that an ambient signal of this spectral bin will be included in a channel of the up-mixed ambient audio signal which is intended for a speaker far on the left side of the listener. Accordingly, for this second frequency bin, it may be decided, by the spectral weight computation 330, that ambient signals for this spectral bin should only be included in the first channel (channel 1') of the up-mixed ambient audio signal. This can be effected, for example, by choosing a spectral weight associated with the first up-mixed channel (channel 1') to be different from 0 (for example, 1) and by chosing the other spectral weights (associated with the other up-mix channels 2', 3', 4') as being 0. Thus, if it is found, by the spectral weight computation 230, that the audio source is strongly on the left side of the audio scene, the spectral weight computation chooses the spectral weights such that ambient signal components in the respective spectral bin are distributed (up-mixed) to (one or more) channels of the up-mixed ambient audio signal that are associated to speakers on the left side of the audio scene. Naturally, if it is found, by the spectral weight computations 330, that an audio source is on the right side of the audio scene (when considering the input audio signal or the direct signal) the spectral weight computation 330 chooses the spectral weights such that corresponding spectral components of the extracted ambient signal will be distributed (up-mixed) to (one or more) channels of the up-mixed ambient audio signal which are associated with speaker positions on the right side of the audio scene.

As a third example, a third spectral bin is considered. In the third spectral bin, a spectral weight computation 330 may find that the audio source is "somewhat" on the left side of the audio scene (but not extremely far on the left side of the audio scene). For example, this can be seen from the fact that there is a strong signal in the first channel and a medium signal in the second channel (confer row 419*c*).

In this case, the spectral weight computation 330 may set the spectral weights such that an ambient signal component in the third spectral bin is distributed to channels 1' and 2' of the up-mixed ambient audio signal, which corresponds to placing the ambient signal somewhat on the left side of the auditory scene (but not extremely far on the left side of the auditory scene).

To conclude, by appropriately choosing the spectral weights, the spectral weight computation 330 can determine where the extracted ambient signal components are placed (or panned) in an audio signal scene. The placement of the ambient signal components is performed, for example, on a spectral-bin-by-spectral-bin basis. The decision, where within the spectral scene a specific frequency bin of the extracted ambient signal should be placed, may be made on the basis of an analysis of the input audio signal or on the basis of an analysis of the extracted direct signal. Also, a time delay between the direct signal and the ambient signal may be considered, such that the spectral weights used in the up-mix 350 of the ambient signal may be delayed in time (for example, by one or more frames) when compared to the spectral weights used in the up-mix 340 of the direct signal.

However, phases or phase differences of the input audio signals or of the extracted direct signals may also be considered by the spectral weight combination. Also, the spectral weights may naturally be determined in a fine-tuned manner. For example, the spectral weights do no need to represent an allocation of a channel of the (intermediate) ambient signal to exactly one channel of the up-mixed ambient audio signal. Rather, a smooth distribution over multiple channels or even over all channels may be indicated by the spectral weights.

It should be noted that the functionality described taking reference to FIGS. 3 and 4 can optionally be used in any of the embodiments according to the present invention. However, different concepts for the ambient signal extraction and the ambient signal distribution could also be used.

Also, it should be note that features, functionalities and details described with respect to FIGS. 3 and 4 can be introduced into the other embodiments individually or in combination.

Figure 5:
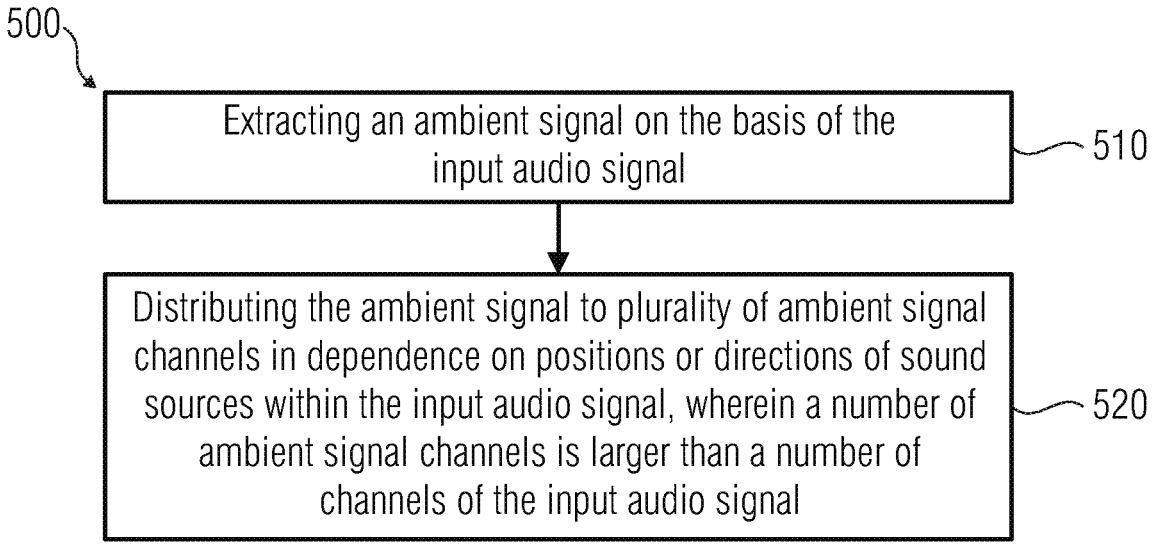
FIG. 5 shows a flowchart of a method for providing ambient signal channels, according to an embodiment of the present invention.

4) Method According to FIG. 5

FIG. 5 shows a flowchart of a method 500 for providing ambient signal channels on the basis of an input audio signal.

The method comprises, in a step 510, extracting an (intermediate) ambient signal on the basis of the input audio signal. The method 500 further comprises, in a step 520, distributing the (extracted intermediate) ambient signal to a plurality of (up-mixed) ambient signal channels, wherein a number of ambient signal channels is larger than a number of channels of the input audio signal, in dependence on positions or directions of sound sources within the input audio signal.

The method 500 according to FIG. 5 can be supplemented by any of the features and functionalities described herein, either individually or in combination. In particular, it should be noted that the method 500 according to FIG. 5 can be supplemented by any of the features and functionalities and details described with respect to the audio signal processor and/or with respect to the system.

Figure 6:
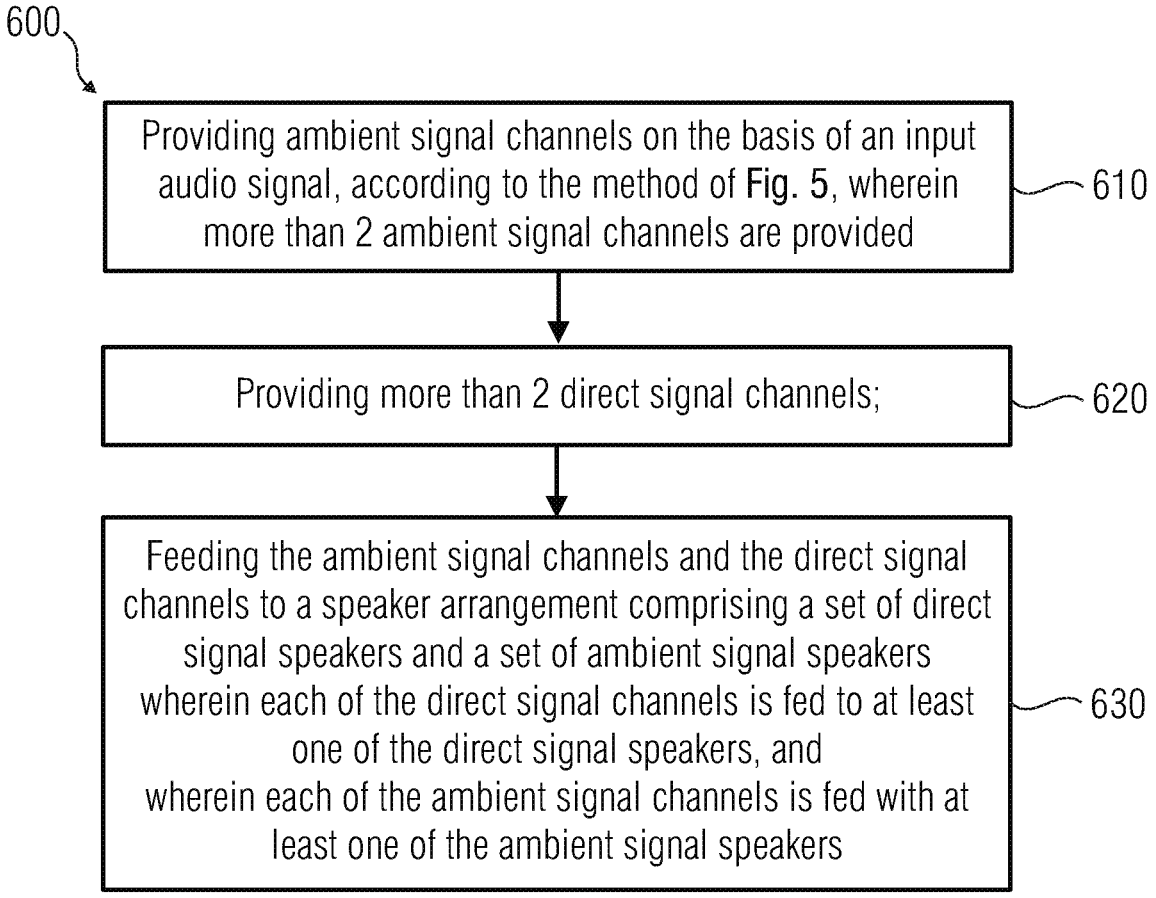
FIG. 6 shows a flowchart of a method for rendering an audio content, according to an embodiment of the present invention.

5) Method According to FIG. 6

FIG. 6 shows a flowchart of a method 600 for rendering an audio content represented by a multi-channel input audio signal.

The method comprises providing 610 ambient signal channels on the basis of an input audio signal, wherein more than two ambient signal channels are provided. The provision of the ambient signal channels may, for example, be performed according to the method 500 described with respect to FIG. 5.

The method 600 also comprises providing 620 more than two direct signal channels.

The method 600 also comprises feeding 630 the ambient signal channels and the direct signal channels to a speaker arrangement comprising a set of direct signal speakers and a set of ambient signal speakers, wherein each of the direct signal channels is fed to at least one of the direct signal speakers, and wherein each of the ambient signal channels is fed to at least one of the ambient signal speakers.

The method 600 can be optionally supplemented by any of the features and functionalities and details described herein, either individually or in combination. For example, the method 600 can also be supplemented by features, functionalities and details described with respect to the audio signal processor or with respect to the system.

6) Further Aspects and Embodiments

In the following, an embodiment according to the present invention will be presented. In particular, details will be presented which can be taken over into any of the other embodiments, either individually or taken in combination. It should be noted that a method will be described which, however, can be performed by the apparatuses and by the system mentioned herein.

6.1. Overview

In the following, an overview will be presented. The features described in the overview can form an embodiment, or can be introduced into other embodiments described herein.

Embodiments according to the present invention introduce the separation of an ambient signal where the ambient signal is itself separated into signal components according to the position of their source signal (for example, according to the position of audio sources exciting the ambient signal). Although all ambient signals are diffuse and therefore do not have a locatable position, many ambient signals, e.g. reverberation, are generated from a (direct) excitation signal with a locatable position. The obtained ambient output signal (for example, the ambient signal channels 112*b* to 112*c* or the ambient signal channels 254*a* to 254*c* or the up-mixed ambient audio signal 352) has more channels (for example, Q channels) than the input signal (for example, N channels), where the output channels (for example, the ambient signal channels) correspond to the positions of the direct source signal that produced the ambient signal component.

The obtained multi-channel ambient signal (for example, represented by the ambient signal channels 112*a* to 112*c* or by the ambient signal channels 254*a* to 254*c*, or by the upmixed ambient audio signal 352) is desired for the upmixing of audio signals, i.e. for creating a signal with Q channels given an input signal with N channels where Q>N. The rendering of the output signals in a multi-channel sound reproduction system is described in the following (and also to some degree in the above description).

6.2 Proposed Rendering of the Extracted Signal

An important aspect of the presented method (and concept) is that the extracted ambient signal components (for example, the extracted ambient signal 130 or the extracted ambient signal 230 or the extracted ambient signal 324) are distributed among the ambient channel signals (for example, among the signals 112*a* to 112*c* or among the signals 254*a* to 254*c*, or among the channels of the up-mixed ambient audio signal 352) according to the position of their excitation signal (for example, of the direct sound source exciting the respective ambient signals or ambient signal components). In general, all channels (loudspeakers) can be used for reproducing direct signals or ambient signals or both.

Figure 7:
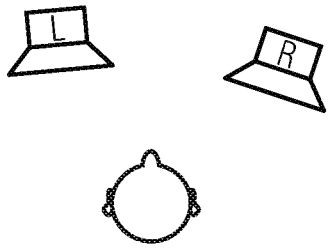
FIG. 7 shows a schematic representation of a standard loudspeaker setup with two loudspeakers (on the left and the right side, "L", "R", respectively) for two-channel stereophony.

FIG. 7 shows a common loudspeaker setup with two loudspeakers which is appropriate for reproducing stereophonic audio signals with two channels. In other words, FIG. 7 shows a standard loudspeaker setup with two loudspeakers (on the left and the right side, "L" and "R", respectively) for two-channel stereophony.

When a loudspeaker setup with more channels is available, a two-channel input signal (for example, the input audio signal 110 or the input audio signal 210 or the input audio signal 310) can be separated into multiple channel signals and the additional output signals are fed into the additional loudspeakers. This process of generating an output signal with more channels than available input channels is commonly referred to as up-mixing.

Figure 8:
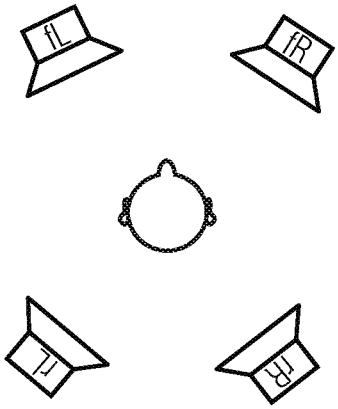
FIG. 8 shows a schematic representation of a quadrophonic loudspeaker setup with four loudspeakers (front left "fL", front right "fR", rear left "rL", rear right "rR")

FIG. 8 illustrates a loudspeaker setup with four loudspeakers. In other words, FIG. 8 shows a quadrophonic loudspeaker setup with four loudspeakers (front left "fL", front right "fR", rear left "rL", rear right "rR"). Worded differently, FIG. 8 illustrates a loudspeaker setup with four loudspeakers. To take advantage of all four loudspeakers when reproducing a signal with two channels, for example, the input signal (for example, the input audio signal 110 or the input audio signal 210 or the input audio signal 310) can be split into a signal with four channels.

Figure 9:
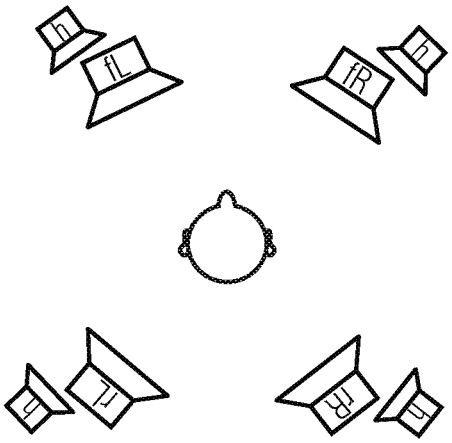
FIG. 9 shows a schematic representation of a quadrophonic loudspeaker setup with additional height loudspeakers marked "h".

Another loudspeaker setup is shown in FIG. 9 with eight loudspeakers where four loudspeakers (the "height" loudspeakers) are elevated, e.g. mounted below the cealing of the listening room. In other words, FIG. 9 shows a quadrophonic loudspeaker setup with additional height loudspeakers marked "h".

When reproducing audio signals using loudspeaker setups having more channels than the input signal, it is common practice to decompose the input signal into meaningful signal components. For the given example, all direct sounds are fed to one of the four lower loudspeakers such that sound sources that are panned to the sides of the input signal are played back by the rear loudspeakers "rL" and "rR". Sound sources that are panned to the center or slightly off center are panned to the front loudspeakers "fL" and "fR". Thereby, the direct sound sources can be distributed among the loudspeakers according to their perceived position in the stereo panorama. The conventional methods compute ambient signals having the same number of channels than the input signals have. When up-mixing a two-channel stereo input signal, a two-channel ambient signal is either fed to a subset of the available loudspeakers or is distributed among all four loudspeakers by feeding one ambient channel signal to multiple loudspeakers.

An important aspect of the presented method is the separation of an ambient signal with Q channels from the input signals with N channels with Q>N. For the given example, an ambient signal with four channels is computed such that the ambient signals that are excited from direct sound sources and panned to the direction of these signals.

In this respect, it should be noted that, for example, the above-mentioned distribution of direct sound sources among the loudspeakers can be performed by the interaction of the direct/ambient decomposition 220 and the ambient signal distribution 240. For example, the spectral weight computation 330 may determine the spectral weights such that the up-mix 340 of the direct signal performs a distribution of direct sound sources as described here (for example, such that sound sources that are panned to the sides of the input signal are played back by rear loudspeakers and such that sound sources that are panned to the center or slightly off center are panned to the front loudspeakers).

Moreover, it should be noted that the four lower loudspeakers mentioned above (fL, fR, rL, rR) may correspond to the speakers 262*a* to 262*c*. Moreover, the height loudspeakers h may correspond to the loudspeakers 264*a* to 264*c*.

In other words, the above-mentioned concept for the distribution of direct sounds may also be implemented in the system 200 according to FIG. 2, and may be achieved by the processing explained with respect to FIGS. 3 and 4.

6.3 Signal Separation Method

In the following, a signal separation method which can be used in embodiments according to the invention will be described.

In a reverberant environment (a recording studio or a concert hall), the sound sources generate reverberation and thereby contribute to the ambiance, together with other diffuse sounds like applause sounds and diffuse environmental noise (e.g. wind noise or rain). For most musical recordings, the reverberation is the most prominent ambient signal. It can be generated acoustically by recording sound sources in a room or by feeding a loudspeaker signal into a room and recording the reverberation signal with a microphone. Reverberation can also be generated artificially by means of a signal processing.

Reverberation is produced by sound sources that are reflected at boundaries (wall, floor, ceiling). The early reflections have typically the largest magnitude and reach the microphones first. The reflections are further reflected with decaying magnitudes and contribute to delayed reverberation. This process can be modelled as an additive mixture of many delayed and scaled copies of the source signal. It is therefore often implemented by means of convolution.

The up-mixing can be carried out either guided by using additional information or unguided by using the audio input signal exclusively without any additional information. Here, we focus on the more challenging procedure of blind up-mixing. Similar concepts can be applied when using the guided approach with the appropriate meta-data.

An input signal x(t) is assumed to be an additive mixture of a direct signal d(t) and an ambient signal a(t).

$$x(t)=d(t)+a(t). \tag{1}$$

All signals have multiple channel signals. The i-th channel signal of the input, direct or ambient signal are denoted by $x_i(t)$, $d_i(t)$ and $a_i(t)$, respectively. the multi-channel signals can then be written as $x(t)=[x_1(t) \ldots x_N(t)]^T$, $d(t)=[d_1(t) \ldots d_N(t)]^T$ and $a(t)=[a_1(t) \ldots a_N(t)]^T$, where N is the number of channels.

The processing (for example, the processing performed by the apparatuses and methods according to the present invention; for example, the processing performed by the apparatus 100 or by the system 200, or the processing as shown in FIGS. 3 and 4) is carried out in the time-frequency domain by using a short-term Fourier transform or another reconstruction filter bank. In the time-frequency domain, the signal model is written as $$X(m,k)=D(m,k)+A(m,k), \tag{2}$$

where X(m, k), D(m, k) and A(m, k) are the spectral coefficients of x(t), d(t) and a(t), respectively, m denotes the time index and k denotes the frequency bin (or subband) index. In the following, time and subband indices are omitted when possible.

The direct signal itself can consist of multiple signal components $D_j^c$ that are generated by multiple sound sources, written in frequency domain notation as $$D=\sum_{j=1}^{S} D_j^c, \tag{3}$$

and in the time domain notation as $$d=\sum_{j=1}^{S} d_j^c, \tag{4}$$

with S being the number of sound sources. The signal components are panned to different positions.

The generation of a reverberation signal component $r^c$ by a direct signal component $d^c$ is modelled as linear time-invariant (LTI) process and can in the time domain be synthesized by means of convolution of the direct signal with an impulse response characterizing the reverberation process.

$$r^c=h^c*d^c, \tag{5}$$

The impulse responses of reverberation processes used for music production are decaying, often exponentially decaying. The decay can be specified by means of the reverberation time. The reverberation time is the time after which the level of reverberation signal is decayed to a fraction of the initial sound after the initial sound is mute. The reverberation time can for example be specified as "RT60", i.e. the time it takes for the reverberation signal to reduce by 60 dB. The reverberation time RT60 of common rooms, halls and other reverberation processes range between 100 ms to 6 s.

It should be noted that the above-mentioned models of the signals x(t), x(t), X(m,k) and $r^c$ described above may represent the characteristics of the input audio signal 110, of the input audio signal 210 and/or of the input audio signal 310, and may be exploited when performing the ambient signal extraction 120 or when performing the direct/ambient decomposition 220 or the direct/ambient decomposition 320.

In the following, a key concept underlying the present invention will be described, which can be applied in the apparatus 100, in the system 200 and implemented by the functionality described with respect to FIGS. 3 and 4.

According to an aspect of the present invention, it is proposed to separate (or to provide) an ambient signal $\hat{A}^p$ with Q channels. For example, the method comprises the following:

1. separate an ambient signal $\hat{A}$ with N channels,
2. compute spectral weights (7) for separating sound sources according their position in the spatial image from the input signal, for all positions p=1 . . . P,
3. upmix the obtained ambient signal to Q channels by means of spectral weighting (6).

$$\hat{A}^p=G^p\hat{A}, \tag{6}$$

For example, the separation of the ambient signal $\tilde{A}$ with N channels may be performed by the ambient signal extraction 120 or by the direct/ambient decomposition 220 or by the direct/ambient decomposition 320.

Moreover, the computation of spectral weights may be performed by the audio signal processor 100 or by the audio signal processor 250 or by the spectral weight computation 330. Furthermore, the up-mixing of the obtained ambient signal to Q channels may, for example, be performed by the ambient signal distribution 140 or by the ambient signal distribution 240 or by the up-mixing 350. The spectral weights (for example, the spectral weights 332, which may be represented by the rows 449*a* to 449*e* in FIG. 4) may, for example, be derived from analyzing the input signal X (for example, the input audio signal 110 or the input audio signal 210 or the input audio signal 310).

$$G^p=f(X), \tag{7}$$

The spectral weights $G^p$ are computed such that they can separate sound sources panned to position p from the input signal. The spectral weights $G^p$ are optionally delayed (shifted in time) before applying to the estimated ambient signal $\hat{A}$ to account for the time delay in the impulse response of the reverberation (pre-delay).

Various methods for both processing steps of the signal separation are feasible. In the following, two suitable methods are described.

However, it should be noted that the methods described in the following should be considered as examples only, and that the methods should be adapted to the specific application in accordance with the invention. It should be noted that no or only minor amendments are required with respect to the ambient signal separation method.

Moreover, it should be noted that the computation of spectral weights also does not need to be adapted strongly. Rather, the computation of spectral weights mentioned in the following can, for example, be performed on the basis of the input audio signal 110, 210, 310. However, the spectral weights obtained by the method (for the computation of spectral weights) described in the following will be applied to the up-mixing of the extracted ambient signal, rather than to the up-mixing of the input signal or to the up-mixing of the direct signal.

6.4 Ambient Signal Separation Method

A possible method for ambient signal separation is described in the international patent application PCT/EP2013/072170 "Apparatus and method for multi-channel direct-ambient decomposition for audio signal processing".

However, different methods can be used for the ambient signal separation, and modifications to said method are also possible, as long as there is an extraction of an ambient signal or a decomposition of an input signal into a direct signal and an ambient signal.

6.5 Method for Computing Spectral Weights for Spatial Positions

A possible method for computing spectral weights for spatial positions is described in the international patent application WO 2013004698 A1 "Method and apparatus for decomposing a stereo recording using frequency-domain processing employing a spectral weights generator".

However, it should be noted that different methods for obtaining spectral weights (which may, for example, define the matrix GP) can be used. Also, the method according to WO 2013004698 A1 could also be modified, as long as it is ensured that spectral weights for separating sound sources according to their positions in the spatial image are derived for a number of channels which corresponds to the desired number of output channels.

7. Conclusions

In the following, some conclusions will be provided. However, it should be noted that the ideas as described in the conclusions could also be introduced into any of the embodiments disclosed herein.

It should be noted that a method for decomposing an audio input signal into direct signal components and ambient signal components is described. The method can be applied for sound post-production and reproduction. The aim is to compute an ambient signal where all direct signal components are attenuated and only the diffuse signal components are audible.

It is an important aspect of the presented method that such ambient signal components are separated according to the position of their source signal. Although all ambient signals are diffuse and therefore do not have a position, many ambient signals, e.g. reverberation, are generated from a direct excitation signal with a defined position. The obtained ambient output signal which may, for example, be represented by the ambient signal channels 112*a* to 112*c* or by the ambient channel signals 254*a* to 254*c* or by the up-mixed ambient audio signal 352, has more channels (for example, Q channels) than the input signal (for example, N channels), wherein the output channels (for example, the ambient signal channels 112*a* to 112*c* or the ambient signal channels 254*a* to 254*c*) correspond to the positions of the direct excitation signal (which may, for example, be included in the input audio signal 110 or in the input audio signal 210 or in the input audio signal 310).

To further conclude, various methods have been proposed for separating the signal components (or all signal components) or the direct signal components only according to their locations in the stereo image (cf., for example, References [2], [10], [11] and [12]). Embodiments according to the invention extend this (conventional) concept to the ambient signal components.

To further conclude, embodiments according to the invention are related to an ambient signal extraction and upmixing. Embodiments according to the invention can be applied, for example, in automotive applications.

Embodiments according to the invention can, for example, be applied in the context of a "symphoria" concept.

Embodiments according to the invention can also be applied to create a 3D-panorama.

8. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] J. B. Allen, D. A. Berkeley, and J. Blauert, "Multimicrophone signal-processing technique to remove room reverberation from speech signals," J. Acoust. Soc. Am., vol. 62, 1977.

[2] C. Avendano and J.-M. Jot, "A frequency-domain approach to multi-channel upmix," J. Audio Eng. Soc., vol. 52, 2004.

[3] C. Faller, "Multiple-loudspeaker playback of stereo signals," J. Audio Eng. Soc., vol. 54, 2006.

[4] J. Merimaa, M. Goodwin, and J.-M. Jot, "Correlation-based ambience extraction from stereo recordings," in Proc. Audio Eng. Soc. /23rd Conv., 2007.

[5] J. Usher and J. Benesty, "Enhancement of spatial sound quality: A new reverberation-extraction audio upmixer," IEEE Trans. Audio, Speech, and Language Process., vol. 15, pp. 2141-2150, 2007.

[6] G. Soulodre, "System for extracting and changing the reverberant content of an audio input signal," U.S. Pat. No. 8,036,767, October 2011.

[7] J. He, E.-L. Tan, and W.-S. Gan, "Linear estimation based primary-ambient extraction for stereo audio signals," IEEE/ACM Trans. Audio, Speech, and Language Process., vol. 22, no. 2, 2014.

[8] C. Uhle and E. Habets, "Direct-ambient decomposition using parametric Wiener filtering with spatial cue control," in Proc. Int. Conf on Acoust., Speech and Sig. Process., ICASSP, 2015.

[9] A. Walther and C. Faller, "Direct-ambient decomposition and upmix of surround sound signals," in Proc. IEEE WASPAA, 2011.

[10] D. Barry, B. Lawlor, and E. Coyle, "Sound source separation: Azimuth discrimination and resynthesis," in Proc. Int. Conf Digital Audio Effects (DAFx), 2004.

[11] C. Uhle, "Center signal scaling using signal-to-downmix ratios," in Proc. Int. Corif. Digital Audio Effects, DAFx, 2013.

[12) C. Uhle and E. Habets, "Subband center signal scaling using power ratios," in Proc. AES 53rd Conf Semantic Audio, 2014.

The invention claimed is:

1. An audio signal processor for providing ambient signal channels on the basis of an input audio signal, wherein the audio signal processor is configured to acquire the ambient signal channels, wherein a number of acquired ambient signal channels comprising different audio content is larger than a number of channels of the input audio signal;

wherein the audio signal processor is configured to acquire the ambient signal channels such that ambient signal components are distributed among the ambient signal channels in dependence on positions or directions of sound sources within the input audio signal;

wherein the audio signal processor is configured to extract an ambient signal on the basis of the input audio signal;

wherein the audio signal processor is configured to distribute ambient signal components among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels.

2. An audio signal processor for providing ambient signal channels on the basis of an input audio signal, wherein the audio signal processor is configured to acquire the ambient signal channels, wherein a number of acquired ambient signal channels comprising different audio content is larger than a number of channels of the input audio signal;

wherein the audio signal processor is configured to acquire the ambient signal channels such that ambient signal components are distributed among the ambient signal channels in dependence on positions or directions of sound sources within the input audio signal;

wherein the audio signal processor is configured to acquire a direct signal, which comprises direct sound components, on the basis of the input audio signal;

wherein the audio signal processor is configured to extract an ambient signal on the basis of the input audio signal; and wherein the signal processor is configured to distribute the ambient signal to a plurality of ambient signal channels in dependence on positions or directions of sound sources within the input audio signal, wherein a number of ambient signal channels is larger than a number of channels of the input audio signal;

wherein the ambient signal channels are associated with different directions;

wherein direct signal channels are associated with different directions, wherein the ambient signal channels and the direct signal channels are associated with a same set of directions, or wherein the ambient signal channels are associated with a subset of a set of directions associated with the direct signal channels; and wherein the audio signal processor is configured to distribute direct signal components among direct signal channels according to positions or directions of respective direct sound components, and wherein the audio signal processor is configured to distribute the ambient signal components among the ambient signal channels according to positions or directions of direct sound sources exciting the respective ambient signal components using same panning coefficients or spectral weights in which the direct signal components are distributed.

3. An audio signal processor for providing ambient signal channels on the basis of an input audio signal, wherein the audio signal processor is configured to acquire the ambient signal channels, wherein a number of acquired ambient signal channels comprising different audio content is larger than a number of channels of the input audio signal;

wherein the audio signal processor is configured to acquire the ambient signal channels such that ambient signal components are distributed among the ambient signal channels in dependence on positions or directions of sound sources within the input audio signal;

wherein the audio signal processor is configured to acquire a direct signal, which comprises direct sound components, on the basis of the input audio signal;

wherein the audio signal processor is configured to extract an ambient signal on the basis of the input audio signal; and wherein the signal processor is configured to distribute the ambient signal to a plurality of ambient signal channels in dependence on positions or directions of sound sources within the input audio signal, wherein a number of ambient signal channels is larger than a number of channels of the input audio signal;

wherein the audio signal processor is configured to acquire a direct signal on the basis of the input audio signal;

wherein the audio signal processor is configured to apply spectral weights, in order to distribute the ambient signal to the ambient signal channels;

wherein the audio signal processor is configured to apply a same set of spectral weights for distributing direct signal components to direct signal channels and for distributing ambient signal components of the ambient signal to ambient signal channels.

4. The audio signal processor according to claim 1, wherein the audio signal processor is configured to acquire the ambient signal channels such that the ambient signal components are distributed among the ambient signal channels according to positions or directions of direct sound sources exciting the respective ambient signal components.

5. The audio signal processor according to claim 1, wherein the audio signal processor is configured to distribute one or more channels of the input audio signal to a plurality of upmixed channels, wherein a number of upmixed channels is larger than the number of channels of the input audio signal, and wherein the audio signal processor is configured to extract the ambient signal channels from the upmixed channels.

6. The audio signal processor according to claim 5, wherein the audio signal processor is configured to extract the ambient signal channels from the upmixed channels using a multi-channel ambient signal extraction or using a multi-channel direct-signal/ambient signal separation.

7. The audio signal processor according to claim 1, wherein the audio signal processor is configured to determine upmixing coefficients and to determine ambient signal extraction coefficients, and wherein the the audio signal processor is configured to acquire the ambient signal channels using the upmixing coefficients and the ambient signal extraction coefficients.

8. An audio signal processor for providing ambient signal channels on the basis of an input audio signal, according to claim 1, wherein the audio signal processor is configured to extract an ambient signal on the basis of the input audio signal; and wherein the signal processor is configured to distribute the ambient signal to a plurality of ambient signal channels in dependence on positions or directions of sound sources within the input audio signal, wherein a number of ambient signal channels is larger than a number of channels of the input audio signal.

9. The audio signal processor according to claim 1, wherein the audio signal processor is configured to perform a direct-ambient separation on the basis of the input audio signal, in order to derive the ambient signal.

10. The audio signal processor according to claim 1, wherein the audio signal processor is configured to distribute ambient signal components among the ambient signal channels according to positions or directions of direct sound sources exciting respective ambient signal components.

11. The audio signal processor according to claim 10, wherein the ambient signal channels are associated with different directions.

12. The audio signal processor according to claim 11, wherein direct signal channels are associated with different directions, wherein the ambient signal channels and the direct signal channels are associated with a same set of directions, or wherein the ambient signal channels are associated with a subset of a set of directions associated with the direct signal channels; and wherein the audio signal processor is configured to distribute direct signal components among direct signal channels according to positions or directions of respective direct sound components, and wherein the audio signal processor is configured to distribute the ambient signal components among the ambient signal channels according to positions or directions of direct sound sources exciting the respective ambient signal components in the same manner in which the direct signal components are distributed.

13. The audio signal processor according to claim 1, wherein the audio signal processor is configured to provide the ambient signal channels such that the ambient signal is separated into ambient signal components according to positions of source signals underlying the ambient signal components.

14. The audio signal processor according to claim 1, wherein the audio signal processor is configured to apply spectral weights, in order to distribute the ambient signal among the ambient signal channels.

15. The audio signal processor according to claim 14, wherein the audio signal processor is configured to apply spectral weights, which are computed to separate directional audio sources according to their positions or directions, in order to up-mix the ambient signal to the plurality of ambient signal channels, or wherein the audio signal processor is configured to apply a delayed version of spectral weights, which are computed to separate directional audio sources according to their positions or directions, in order to up-mix the ambient signal to the plurality of ambient signal channels.

16. The audio signal processor according to claim 14, wherein the audio signal processor is configured to derive the spectral weights such that the spectral weights are time-dependent and frequency-dependent.

17. The audio signal processor according to claim 14, wherein the audio signal processor is configured to derive the spectral weights in dependence on positions or directions of sound sources in a spatial sound image of the input audio signal.

18. The audio signal processor according to claim 14, wherein the input audio signal comprises at least two input channel signals, and wherein the audio signal processor is configured to derive the spectral weights in dependence on differences between the at least two input channel signals.

19. The audio signal processor according to claim 14, wherein the audio signal processor is configured to determine the spectral weights in dependence on positions or directions from which spectral components originate, such that spectral components originating from a given position or direction are weighted stronger in a channel associated with the respective position or direction when compared to other channels.

20. The audio signal processor according to claim 14, wherein the audio signal processor is configured to determine the spectral weights such that the spectral weights describe a weighting of spectral components of input channel signals in a plurality of output channel signals.

21. The audio signal processor according to claim 14, wherein the audio signal processor is configured to apply a same set of spectral weights for distributing direct signal components to direct signal channels and for distributing ambient signal components of the ambient signal to ambient signal channels.

22. The audio signal processor according to claim 1, wherein the input audio signal comprises at least 2 channels, and/or wherein the ambient signal comprises at least 2 channels.

23. A system for rendering an audio content represented by a multi-channel input audio signal, comprising:

an audio signal processor according to claim 1, wherein the audio signal processor is configured to provide more than 2 direct signal channels and more than 2 ambient signal channels; and a speaker arrangement comprising a set of direct signal speakers and a set of ambient signal speakers, wherein each of the direct signal channels is associated to at least one of the direct signal speakers, and wherein each of the ambient signal channels is associated with at least one of the ambient signal speakers.

24. The system according to claim 23, wherein each of the ambient signal speakers is associated with one of the direct signal speakers.

25. The system according to claim 23, wherein positions of the ambient signal speakers are elevated with respect to positions of the direct signal speakers.

26. A method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels.

27. A method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the method comprises distributing the ambient signal to a plurality of ambient signal channels in dependence on positions or directions of sound sources within the input audio signal, wherein a number of ambient signal channels is larger than a number of channels of the input audio signal;

wherein the ambient signal channels are associated with different directions;

wherein direct signal channels are associated with different directions, wherein the ambient signal channels and the direct signal channels are associated with a same set of directions, or wherein the ambient signal channels are associated with a subset of a set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using same panning coefficients or spectral weights in which the direct signal components are distributed.

28. A method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal;

wherein a direct signal is acquired on the basis of the input audio signal;

wherein spectral weights are applied, in order to distribute the ambient signal to the ambient signal channels;

wherein a same set of spectral weights is applied for distributing direct signal components to direct signal channels and for distributing ambient signal components of the ambient signal to ambient signal channels.

29. The method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels, wherein the method comprises extracting an ambient signal on the basis of the input audio signal; and wherein the method comprises distributing the ambient signal to a plurality of ambient signal channels in dependence on positions or directions of sound sources within the input audio signal, wherein a number of ambient signal channels is larger than a number of channels of the input audio signal.

30. The method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the method comprises distributing the ambient signal to a plurality of ambient signal channels in dependence on positions or directions of sound sources within the input audio signal, wherein a number of ambient signal channels is larger than a number of channels of the input audio signal;

wherein the ambient signal channels are associated with different directions;

wherein direct signal channels are associated with different directions, wherein the ambient signal channels and the direct signal channels are associated with a same set of directions, or wherein the ambient signal channels are associated with a subset of a set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using same panning coefficients or spectral weights in which the direct signal components are distributed, wherein the method comprises extracting an ambient signal on the basis of the input audio signal; and wherein the method comprises distributing the ambient signal to plurality of ambient signal channels in dependence on positions or directions of sound sources within the input audio signal, wherein a number of ambient signal channels is larger than a number of channels of the input audio signal.

31. The method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal;

wherein a direct signal is acquired on the basis of the input audio signal;

wherein spectral weights are applied, in order to distribute the ambient signal to the ambient signal channels;

wherein a same set of spectral weights is applied for distributing direct signal components to direct signal channels and for distributing ambient signal components of the ambient signal to ambient signal channels.

wherein the method comprises extracting an ambient signal on the basis of the input audio signal; and wherein the method comprises distributing the ambient signal to plurality of ambient signal channels in dependence on positions or directions of sound sources within the input audio signal, wherein a number of ambient signal channels is larger than a number of channels of the input audio signal.

32. A method for rendering an audio content represented by a multi-channel input audio signal, comprising:

providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels, wherein more than 2 ambient signal channels are provided;

providing more than 2 direct signal channels;

feeding the ambient signal channels and the direct signal channels to a speaker arrangement comprising a set of direct signal speakers and a set of ambient signal speakers, wherein each of the direct signal channels is fed to at least one of the direct signal speakers, and wherein each of the ambient signal channels is fed with at least one of the ambient signal speakers.

33. A method for rendering an audio content represented by a multi-channel input audio signal, comprising:

providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the method comprises distributing the ambient signal to a plurality of ambient signal channels in dependence on positions or directions of sound sources within the input audio signal, wherein a number of ambient signal channels is larger than a number of channels of the input audio signal;

wherein the ambient signal channels are associated with different directions;

wherein direct signal channels are associated with different directions, wherein the ambient signal channels and the direct signal channels are associated with a same set of directions, or wherein the ambient signal channels are associated with a subset of a set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using same panning coefficients or spectral weights in which the direct signal components are distributed, wherein more than 2 ambient signal channels are provided;

providing more than 2 direct signal channels;

feeding the ambient signal channels and the direct signal channels to a speaker arrangement comprising a set of direct signal speakers and a set of ambient signal speakers, wherein each of the direct signal channels is fed to at least one of the direct signal speakers, and wherein each of the ambient signal channels is fed with at least one of the ambient signal speakers.

34. A method for rendering an audio content represented by a multi-channel input audio signal, comprising:

providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal;

wherein a direct signal is acquired on the basis of the input audio signal;

wherein spectral weights are applied, in order to distribute the ambient signal to the ambient signal channels;

wherein a same set of spectral weights is applied for distributing direct signal components to direct signal channels and for distributing ambient signal components of the ambient signal to ambient signal channels, wherein more than 2 ambient signal channels are provided;

providing more than 2 direct signal channels;

feeding the ambient signal channels and the direct signal channels to a speaker arrangement comprising a set of direct signal speakers and a set of ambient signal speakers, wherein each of the direct signal channels is fed to at least one of the direct signal speakers, and wherein each of the ambient signal channels is fed with at least one of the ambient signal speakers.

35. A non-transitory digital storage medium having a computer program stored thereon to perform a method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein ambient signal components are distributed among the ambient signal channels according to positions or directions of direct sound sources exciting respective ambient signal components, such that different ambient signal components excited by different sources located at different positions are distributed differently among the ambient signal channels, and such that a distribution of ambient signal components to different ambient signal channels corresponds to a distribution of direct signal components exciting the respective ambient signal components to different direct signal channels, when said computer program is run by a computer.

36. A non-transitory digital storage medium having a computer program stored thereon to perform a method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the method comprises distributing the ambient signal to a plurality of ambient signal channels in dependence on positions or directions of sound sources within the input audio signal, wherein a number of ambient signal channels is larger than a number of channels of the input audio signal;

wherein the ambient signal channels are associated with different directions;

wherein direct signal channels are associated with different directions, wherein the ambient signal channels and the direct signal channels are associated with a same set of directions, or wherein the ambient signal channels are associated with a subset of a set of directions associated with the direct signal channels; and wherein direct signal components are distributed among direct signal channels according to positions or directions of respective direct sound components, and wherein the ambient signal components are distributed among the ambient signal channels according to positions or directions of direct sound sources exciting the respective ambient signal components using same panning coefficients or spectral weights in which the direct signal components are distributed, when said computer program is run by a computer.

37. A non-transitory digital storage medium having a computer program stored thereon to perform a method for providing ambient signal channels on the basis of an input audio signal, wherein the method comprises acquiring the ambient signal channels such that ambient signal components are distributed among the ambient signal channels in dependence on positions or directions of sound sources within the input audio signal, wherein a number of acquired ambient signal channels comprising different audio content is larger than a number of channels of the input audio signal;

wherein the method comprises acquiring a direct signal, which comprises direct sound components, on the basis of the input audio signal;

wherein the method comprises extracting an ambient signal on the basis of the input audio signal; and wherein the ambient signal is distributed to a plurality of ambient signal channels in dependence on positions or directions of sound sources within the input audio signal, wherein a number of ambient signal channels is larger than a number of channels of the input audio signal;

wherein a direct signal is acquired on the basis of the input audio signal;

wherein spectral weights are applied, in order to distribute the ambient signal to the ambient signal channels;

wherein a same set of spectral weights is applied for distributing direct signal components to direct signal channels and for distributing ambient signal components of the ambient signal to ambient signal channels, when said computer program is run by a computer.

38. A system for rendering an audio content represented by a multi-channel input audio signal, comprising:

an audio signal processor for providing ambient signal channels on the basis of an input audio signal, wherein the audio signal processor is configured to acquire the ambient signal channels, wherein a number of acquired ambient signal channels comprising different audio content is larger than a number of channels of the input audio signal;

wherein the audio signal processor is configured to acquire the ambient signal channels such that ambient signal components are distributed among the ambient signal channels in dependence on positions or directions of sound sources within the input audio signal;

wherein the audio signal processor is configured to provide more than 2 direct signal channels and more than 2 ambient signal channels; and a speaker arrangement comprising a set of direct signal speakers and a set of ambient signal speakers, wherein each of the direct signal channels is associated to at least one of the direct signal speakers, and wherein each of the ambient signal channels is associated with at least one of the ambient signal speakers, such that direct signals and ambient signals are rendered using different speakers.

39. The system according to claim 38, wherein there is an association between direct signal speakers and ambient signal speakers, or wherein there is an association between a subset of the direct signal speakers and the ambient signal speakers.

* * * * *